US011779812B2

(12) United States Patent
Watterson

(10) Patent No.: US 11,779,812 B2
(45) Date of Patent: Oct. 10, 2023

(54) TREADMILL CONFIGURED TO AUTOMATICALLY DETERMINE USER EXERCISE MOVEMENT

(71) Applicant: iFIT Inc., Logan, UT (US)

(72) Inventor: Scott R. Watterson, Providence, UT (US)

(73) Assignee: iFIT Inc., Logan, UT (US)

( * ) Notice: Subject to any disclaimer, the term of this patent is extended or adjusted under 35 U.S.C. 154(b) by 144 days.

(21) Appl. No.: 17/214,123

(22) Filed: Mar. 26, 2021

(65) Prior Publication Data

US 2021/0213331 A1 Jul. 15, 2021

Related U.S. Application Data

(63) Continuation of application No. 16/378,022, filed on Apr. 8, 2019, now Pat. No. 10,994,173, which is a (Continued)

(51) Int. Cl.
*A63B 24/00* (2006.01)
*A63B 71/00* (2006.01)
(Continued)

(52) U.S. Cl.
CPC ..... *A63B 24/0075* (2013.01); *A61H 1/005* (2013.01); *A63B 21/06* (2013.01);
(Continued)

(58) Field of Classification Search
CPC ..... A61H 1/005; A61H 2201/0165; A61H 2201/5097; A61H 2201/1215;
(Continued)

(56) References Cited

U.S. PATENT DOCUMENTS 3,123,646 A 3/1964 Easton
3,579,339 A 5/1971 Du Pont
(Continued)

FOREIGN PATENT DOCUMENTS

KR 100829744 5/2018
WO 20000030717 6/2000
(Continued)

OTHER PUBLICATIONS

U.S. Appl. No. 29/568,648, filed Jun. 20, 2016, ICON Health & Fitness, Inc.
(Continued)

*Primary Examiner* — Megan Anderson
(74) *Attorney, Agent, or Firm* — RAY QUINNEY & NEBEKER P.C.; Paul N. Taylor

(57) ABSTRACT

Treadmill configured to automatically determine user exercise movement. In some embodiments, a treadmill may include a deck, a first pulley disposed in the deck, a second pulley disposed in the deck, a tread belt surrounding the first pulley and the second pulley, an electronic sensor incorporated into the treadmill and configured to automatically produce measurement data in response to exercise movement performed by a user over the deck, an electronic console including an electronic display, a processor, and a memory. The memory may include programmed instructions that, when executed, cause the processor to automatically analyze the measurement data produced by the electronic sensor to automatically determine a characteristic of the exercise movement performed by the user over the deck, and automatically present, on the electronic display, an indication of the characteristic of the exercise movement performed by the user over the deck.

19 Claims, 11 Drawing Sheets

Related U.S. Application Data continuation of application No. 15/461,246, filed on Mar. 16, 2017, now Pat. No. 10,252,109.

(60) Provisional application No. 62/336,567, filed on May 13, 2016.

(51) Int. Cl.

| | |
|---|---|
| ***A63B 22/00*** | (2006.01) |
| ***A63B 71/06*** | (2006.01) |
| ***A61H 1/00*** | (2006.01) |
| ***A63B 21/072*** | (2006.01) |
| ***A63B 22/02*** | (2006.01) |
| ***A63B 21/06*** | (2006.01) |
| ***A63B 69/00*** | (2006.01) |

(52) U.S. Cl.

CPC ..... *A63B 21/072* (2013.01); *A63B 21/0726* (2013.01); *A63B 22/0023* (2013.01); *A63B 22/02* (2013.01); *A63B 22/0207* (2015.10); *A63B 22/0214* (2015.10); *A63B 22/0235* (2013.01); *A63B 22/0285* (2013.01); *A63B 69/0062* (2020.08); *A63B 71/0036* (2013.01); *A63B 71/0619* (2013.01); *A63B 71/0622* (2013.01); *A63B 71/0686* (2013.01); *A61H 2201/0165* (2013.01); *A61H 2201/1215* (2013.01); *A61H 2201/5043* (2013.01); *A61H 2201/5058* (2013.01); *A61H 2201/5079* (2013.01); *A61H 2201/5084* (2013.01); *A61H 2201/5092* (2013.01); *A61H 2201/5097* (2013.01); *A61H 2203/0406* (2013.01); *A63B 2071/065* (2013.01); *A63B 2071/0694* (2013.01); *A63B 2209/08* (2013.01); *A63B 2220/17* (2013.01); *A63B 2220/20* (2013.01); *A63B 2220/30* (2013.01); *A63B 2220/40* (2013.01); *A63B 2220/52* (2013.01); *A63B 2220/80* (2013.01); *A63B 2220/805* (2013.01); *A63B 2220/806* (2013.01); *A63B 2220/808* (2013.01); *A63B 2225/20* (2013.01); *A63B 2225/682* (2013.01); *A63B 2230/01* (2013.01); *A63B 2230/06* (2013.01); *A63B 2230/75* (2013.01)

(58) Field of Classification Search

CPC .... A61H 2201/5058; A61H 2201/5079; A61H 2201/5087; A63B 21/06; A63B 21/0726; A63B 21/072; A63B 22/02; A63B 22/0214; A63B 22/0207; A63B 24/0075; A63B 71/0622; A63B 71/0619; A63B 71/0686

See application file for complete search history.

(56) References Cited

U.S. PATENT DOCUMENTS

| | | | |
|---|---|---|---|
| 4,023,795 | A | 5/1977 | Pauls |
| 4,300,760 | A | 11/1981 | Bobroff |
| 4,413,821 | A | 11/1983 | Centafanti |
| D286,311 | S | 10/1986 | Martinell et al. |
| 4,681,318 | A | 7/1987 | Lay |
| 4,684,126 | A | 8/1987 | Dalebout et al. |
| 4,705,028 | A | 11/1987 | Melby |
| 4,728,102 | A | 3/1988 | Pauls |
| 4,750,736 | A | 6/1988 | Watterson |
| 4,796,881 | A | 1/1989 | Watterson |
| 4,813,667 | A | 3/1989 | Watterson |
| 4,830,371 | A | 5/1989 | Lay |
| 4,844,451 | A | 7/1989 | Bersonnet et al. |
| 4,850,585 | A | 7/1989 | Dalebout |
| D304,849 | S | 11/1989 | Watterson |
| 4,880,225 | A | 11/1989 | Lucas et al. |
| 4,883,272 | A | 11/1989 | Lay |
| D306,468 | S | 3/1990 | Waterson |
| D306,891 | S | 3/1990 | Watterson |
| 4,913,396 | A | 4/1990 | Dalebout et al. |
| D307,614 | S | 5/1990 | Bingham et al. |
| D307,615 | S | 5/1990 | Bingham et al. |
| 4,921,242 | A | 5/1990 | Watterson |
| 4,932,650 | A | 6/1990 | Bingham et al. |
| D309,167 | S | 7/1990 | Griffin |
| D309,485 | S | 7/1990 | Bingham et al. |
| 4,938,478 | A | 7/1990 | Lay |
| D310,253 | S | 8/1990 | Bersonnet et al. |
| 4,955,599 | A | 9/1990 | Bersonnet et al. |
| 4,971,316 | A | 11/1990 | Dalebout et al. |
| D313,055 | S | 12/1990 | Watterson |
| 4,974,832 | A | 12/1990 | Dalebout |
| 4,979,737 | A | 12/1990 | Kock |
| 4,981,294 | A | 1/1991 | Dalebout et al. |
| D315,765 | S | 3/1991 | Measom et al. |
| 4,998,725 | A | 3/1991 | Watterson et al. |
| 5,000,442 | A | 3/1991 | Dalebout et al. |
| 5,000,443 | A | 3/1991 | Dalebout et al. |
| 5,000,444 | A | 3/1991 | Dalebout et al. |
| D316,124 | S | 4/1991 | Dalebout et al. |
| 5,013,033 | A | 5/1991 | Watterson et al. |
| 5,014,980 | A | 5/1991 | Bersonnet et al. |
| 5,016,871 | A | 5/1991 | Dalebout et al. |
| D318,085 | S | 7/1991 | Jacobson et al. |
| D318,086 | S | 7/1991 | Bingham et al. |
| D318,699 | S | 7/1991 | Jacobson et al. |
| 5,029,801 | A | 7/1991 | Dalebout et al. |
| 5,034,576 | A | 7/1991 | Dalebout et al. |
| 5,058,881 | A | 10/1991 | Measom |
| 5,058,882 | A | 10/1991 | Dalebout et al. |
| D321,388 | S | 11/1991 | Dalebout |
| 5,062,626 | A | 11/1991 | Dalebout et al. |
| 5,062,627 | A | 11/1991 | Bingham |
| 5,062,632 | A | 11/1991 | Dalebout et al. |
| 5,062,633 | A | 11/1991 | Engel et al. |
| 5,067,710 | A | 11/1991 | Watterson et al. |
| 5,072,929 | A | 12/1991 | Peterson et al. |
| D323,009 | S | 1/1992 | Dalebout et al. |
| D323,198 | S | 1/1992 | Dalebout et al. |
| D323,199 | S | 1/1992 | Dalebout et al. |
| D323,863 | S | 2/1992 | Watterson |
| 5,088,729 | A | 2/1992 | Dalebout |
| 5,090,694 | A | 2/1992 | Pauls et al. |
| 5,102,380 | A | 4/1992 | Jacobson et al. |
| 5,104,120 | A | 4/1992 | Watterson et al. |
| 5,108,093 | A | 4/1992 | Watterson |
| D326,491 | S | 5/1992 | Dalebout |
| 5,122,105 | A | 6/1992 | Engel et al. |
| 5,135,216 | A | 8/1992 | Bingham et al. |
| 5,135,458 | A | 8/1992 | Huang |
| 5,147,265 | A | 9/1992 | Pauls et al. |
| 5,149,084 | A | 9/1992 | Dalebout et al. |
| 5,149,312 | A | 9/1992 | Croft et al. |
| 5,158,520 | A | 10/1992 | Lemke |
| 5,171,196 | A | 12/1992 | Lynch |
| D332,347 | S | 1/1993 | Raadt et al. |
| 5,190,505 | A | 3/1993 | Dalebout et al. |
| 5,192,255 | A | 3/1993 | Dalebout et al. |
| 5,195,937 | A | 3/1993 | Engel et al. |
| 5,203,826 | A | 4/1993 | Dalebout |
| D335,511 | S | 5/1993 | Engel et al. |
| D335,905 | S | 5/1993 | Cutter et al. |
| D336,498 | S | 6/1993 | Engel et al. |
| 5,217,487 | A | 6/1993 | Engel et al. |
| D337,361 | S | 7/1993 | Engel et al. |
| D337,666 | S | 7/1993 | Peterson et al. |
| D337,799 | S | 7/1993 | Cutter et al. |
| 5,226,866 | A | 7/1993 | Engel et al. |
| 5,242,339 | A | 9/1993 | Thornton |
| 5,244,446 | A | 9/1993 | Engel et al. |
| 5,247,853 | A | 9/1993 | Dalebout |
| 5,259,611 | A | 11/1993 | Dalebout et al. |
| D342,106 | S | 12/1993 | Campbell et al. |

(56) References Cited

U.S. PATENT DOCUMENTS 5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
5,318,491 A 6/1994 Houston
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,385,520 A 1/1995 Lepine
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,562,285 A * 10/1996 Anfinsen ..... A63B 24/0021 473/192
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout
5,611,539 A 3/1997 Watterson
5,622,527 A 4/1997 Watterson et al.
5,626,538 A 5/1997 Dalebout et al.
5,626,540 A 5/1997 Hall
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,667,461 A 9/1997 Hall
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Watterson et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.
5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen
5,830,114 A 11/1998 Halfen et al.
5,860,893 A 1/1999 Watterson et al.
5,860,894 A 1/1999 Dalebout et al.
5,899,834 A 5/1999 Dalebout et al.
5,921,892 A 7/1999 Easton
D412,953 S 8/1999 Armstrong
D413,948 S 9/1999 Dalebout
5,951,441 A 9/1999 Dalebout
5,951,448 A 9/1999 Bolland
5,951,449 A 9/1999 Oppriecht
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,113,519 A 9/2000 Goto
6,123,646 A 9/2000 Colassi
6,171,217 B1 1/2001 Cutler
6,171,219 B1 1/2001 Simonson
6,174,267 B1 1/2001 Dalebout
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,506,142 B2 1/2003 Itoh
6,527,678 B1 3/2003 Wang
6,547,698 B2 4/2003 Inagawa
6,563,225 B2 5/2003 Soga et al.
6,601,016 B1 7/2003 Brown et al.
6,623,140 B2 9/2003 Watterson
6,626,799 B2 9/2003 Watterson et al.
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,719,667 B2 4/2004 Wong
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,783,482 B2 8/2004 Oglesby
6,786,852 B2 9/2004 Watterson et al.

(56) References Cited

U.S. PATENT DOCUMENTS 6,796,925 B2 9/2004 Martinez
6,808,472 B1 10/2004 Hickman
6,821,230 B2 11/2004 Dalebout et al.
6,830,540 B2 12/2004 Watterson
6,863,641 B1 3/2005 Brown et al.
6,866,613 B1 3/2005 Brown et al.
6,875,160 B2 4/2005 Watterson et al.
6,878,101 B2 4/2005 Colley
D507,311 S 7/2005 Butler et al.
6,918,858 B2 7/2005 Watterson et al.
6,921,351 B1 7/2005 Hickman et al.
6,974,404 B1 12/2005 Watterson et al.
6,997,852 B2 2/2006 Watterson et al.
7,025,713 B2 4/2006 Dalebout
D520,085 S 5/2006 Willardson et al.
7,044,897 B2 5/2006 Myers et al.
7,052,442 B2 5/2006 Watterson
7,060,006 B1 6/2006 Watterson et al.
7,060,008 B2 6/2006 Watterson et al.
7,070,539 B2 7/2006 Brown et al.
7,070,542 B2 7/2006 Reyes
7,097,588 B2 8/2006 Watterson
D527,776 S 9/2006 Willardson et al.
7,112,168 B2 9/2006 Dalebout et al.
7,125,369 B2 10/2006 Endelman
7,128,693 B2 10/2006 Brown et al.
7,132,939 B2 11/2006 Tyndall
7,153,240 B1 12/2006 Wu
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,172,536 B2 2/2007 Liu
7,192,387 B2 3/2007 Mendel
7,192,388 B2 3/2007 Dalebout et al.
7,250,022 B2 7/2007 Dalebout
7,282,016 B2 10/2007 Simonson
7,285,075 B2 10/2007 Cutler et al.
7,344,481 B2 3/2008 Watterson et al.
7,377,882 B2 5/2008 Watterson
7,425,188 B2 9/2008 Ercanbrack
7,429,236 B2 9/2008 Dalebout et al.
7,452,311 B2 11/2008 Barnes
7,455,622 B2 11/2008 Watterson et al.
7,470,219 B2 12/2008 Larson
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Watterson et al.
7,556,590 B2 7/2009 Watterson et al.
7,563,203 B2 7/2009 Dalebout et al.
7,575,536 B1 8/2009 Hickman
7,578,771 B1 8/2009 Towley, III et al.
7,601,105 B1 10/2009 Gipson, III et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout
7,771,320 B2 8/2010 Riley
7,771,329 B2 8/2010 Dalebout et al.
7,775,936 B2 8/2010 Wilkinson
7,775,940 B2 8/2010 Dalebout et al.
7,789,800 B1 9/2010 Watterson et al.
7,798,946 B2 9/2010 Dalebout et al.
7,806,589 B2 10/2010 Tashman
7,815,548 B2 10/2010 Barre
7,815,550 B2 10/2010 Watterson et al.
7,857,731 B2 12/2010 Hickman et al.
7,862,475 B2 1/2011 Watterson
7,862,478 B2 1/2011 Watterson et al.
7,862,483 B2 1/2011 Hendrickson et al.
7,862,489 B2 1/2011 Savsek
7,887,470 B2 2/2011 Chen
D635,207 S 3/2011 Dalebout et al.
7,901,324 B2 3/2011 Kodama
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,985,164 B2 7/2011 Ashby
8,007,409 B2 8/2011 Ellis
8,029,415 B2 10/2011 Ashby et al.
8,033,960 B1 10/2011 Dalebout et al.
D650,451 S 12/2011 Olson et al.
8,075,453 B1 12/2011 Wilkinson
D652,877 S 1/2012 Dalebout et al.
8,152,702 B2 4/2012 Pacheco
8,157,708 B2 4/2012 Daly
D659,775 S 5/2012 Olson et al.
D659,777 S 5/2012 Watterson et al.
D660,383 S 5/2012 Watterson et al.
D664,613 S 7/2012 Dalebout et al.
8,251,874 B2 8/2012 Ashby et al.
8,257,232 B2 9/2012 Albert
8,298,123 B2 10/2012 Hickman
8,298,125 B2 10/2012 Coiledge et al.
D671,177 S 11/2012 Sip
D671,178 S 11/2012 Sip
8,308,618 B2 11/2012 Bayerlein
D673,626 S 1/2013 Olson et al.
8,568,278 B2 10/2013 Riley
8,608,624 B2 12/2013 Shabodyash
8,690,735 B2 4/2014 Watterson et al.
D707,763 S 6/2014 Cutler
8,740,753 B2 6/2014 Olson et al.
8,747,285 B2 6/2014 Hof
8,758,201 B2 6/2014 Ashby et al.
8,771,153 B2 7/2014 Dalebout et al.
8,784,270 B2 7/2014 Watterson
8,784,275 B2 7/2014 Mikan
8,784,278 B2 7/2014 Flake
8,808,148 B2 8/2014 Watterson
8,814,762 B2 8/2014 Butler
D712,493 S 9/2014 Ercanbrack et al.
8,840,075 B2 9/2014 Olson
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Olson
8,911,330 B2 12/2014 Watterson et al.
8,920,288 B2 12/2014 Dalebout
8,920,347 B2 12/2014 Bayerlein
8,979,709 B2 3/2015 Toback
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson
9,039,578 B2 5/2015 Dalebout
D731,011 S 6/2015 Buchanan
9,072,930 B2 7/2015 Ashby et al.

(56) References Cited

U.S. PATENT DOCUMENTS 9,119,983 B2 9/2015 Rhea
9,119,988 B2 9/2015 Murray
9,123,317 B2 9/2015 Watterson et al.
9,126,071 B2 9/2015 Smith
9,126,072 B2 9/2015 Watterson
9,138,615 B2 9/2015 Olson et al.
9,142,139 B2 9/2015 Watterson et al.
9,144,703 B2 9/2015 Dalebout et al.
9,149,683 B2 9/2015 Smith
9,186,535 B2 11/2015 Ercanbrack
9,186,549 B2 11/2015 Watterson et al.
9,186,552 B1 11/2015 Deal
9,227,101 B2 1/2016 Maguire
9,233,272 B2 1/2016 Villani
9,254,416 B2 2/2016 Ashby
9,278,248 B2 3/2016 Tyger
9,278,249 B2 3/2016 Watterson
9,278,250 B2 3/2016 Buchanan
9,289,648 B2 3/2016 Watterson
9,292,935 B2 3/2016 Koduri et al.
9,308,417 B2 4/2016 Grundy
9,339,683 B2 5/2016 Dilli
9,339,691 B2 5/2016 Brammer
9,352,185 B2 5/2016 Hendrickson et al.
9,352,186 B2 5/2016 Watterson
9,364,714 B2 6/2016 Koduri et al.
9,375,605 B2 6/2016 Tyger
9,378,336 B2 6/2016 Ohnemus
9,381,394 B2 7/2016 Mortensen et al.
9,387,387 B2 7/2016 Dalebout
9,393,453 B2 7/2016 Watterson
9,403,047 B2 8/2016 Olson et al.
9,403,051 B2 8/2016 Cutler
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen et al.
9,498,668 B2 11/2016 Smith
9,517,378 B2 12/2016 Ashby et al.
9,521,901 B2 12/2016 Dalebout
9,533,187 B2 1/2017 Dalebout
9,539,461 B2 1/2017 Ercanbrack
9,550,091 B2 1/2017 Emerson
9,579,544 B2 2/2017 Watterson
9,586,086 B2 3/2017 Dalebout et al.
9,586,090 B2 3/2017 Watterson et al.
9,604,099 B2 3/2017 Taylor
9,616,276 B2 4/2017 Dalebout et al.
9,616,278 B2 4/2017 Olson
9,623,281 B2 4/2017 Hendrickson
9,636,567 B2 5/2017 Brammer et al.
9,675,839 B2 6/2017 Dalebout
9,682,307 B2 6/2017 Dalebout
9,694,234 B2 7/2017 Dalebout et al.
9,694,242 B2 7/2017 Ashby
9,737,755 B2 8/2017 Dalebout
9,750,454 B2 9/2017 Walke
9,757,605 B2 9/2017 Olson et al.
9,764,186 B2 9/2017 Dalebout
9,767,785 B2 9/2017 Ashby
9,776,032 B2 10/2017 Moran
9,795,822 B2 10/2017 Smith et al.
9,795,855 B2 10/2017 Jafarifesharaki
9,808,672 B2 11/2017 Dalebout
9,849,326 B2 12/2017 Smith
9,878,210 B2 1/2018 Watterson
9,889,334 B2 2/2018 Ashby et al.
9,889,339 B2 2/2018 Douglass
9,937,376 B2 4/2018 Mclnelly et al.
9,937,377 B2 4/2018 Mclnelly et al.
9,937,378 B2 4/2018 Dalebout et al.
9,937,379 B2 4/2018 Mortensen
9,943,719 B2 4/2018 Smith et al.
9,943,722 B2 4/2018 Dalebout
9,948,037 B2 4/2018 Ashby
9,968,816 B2 5/2018 Olson et al.
9,968,821 B2 5/2018 Finlayson et al.
9,968,823 B2 5/2018 Cutler
9,980,465 B2 5/2018 Hayashi
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack
D827,733 S 9/2018 Hochstrasser
10,065,064 B2 9/2018 Smith et al.
10,071,285 B2 9/2018 Smith et al.
10,085,586 B2 10/2018 Smith et al.
10,086,254 B2 10/2018 Watterson
10,118,064 B1 11/2018 Cox
10,136,842 B2 11/2018 Ashby
10,186,161 B2 1/2019 Watterson
10,188,890 B2 1/2019 Olson et al.
10,207,143 B2 2/2019 Dalebout
10,207,145 B2 2/2019 Tyger
10,207,147 B2 2/2019 Ercanbrack
10,207,148 B2 2/2019 Powell
10,212,994 B2 2/2019 Watterson
10,220,259 B2 3/2019 Brammer
10,226,396 B2 3/2019 Ashby
10,226,664 B2 3/2019 Dalebout
10,252,109 B2 4/2019 Watterson
10,258,828 B2 4/2019 Dalebout et al.
10,272,317 B2 4/2019 Watterson
10,279,212 B2 5/2019 Dalebout et al.
10,293,211 B2 5/2019 Watterson et al.
D852,292 S 6/2019 Cutler
10,342,461 B2 * 7/2019 Basta ..... A61B 5/1038
10,343,017 B2 7/2019 Jackson
10,376,736 B2 8/2019 Powell et al.
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby et al.
10,441,840 B2 10/2019 Dalebout
10,441,844 B2 10/2019 Powell
10,449,416 B2 10/2019 Dalebout
10,471,299 B2 11/2019 Powell
D868,909 S 12/2019 Cutler
10,492,519 B2 12/2019 Capell
10,493,349 B2 12/2019 Watterson
10,500,473 B2 12/2019 Watterson
10,537,764 B2 1/2020 Smith et al.
10,543,395 B2 1/2020 Powell et al.
10,561,877 B2 2/2020 Workman
10,561,893 B2 2/2020 Chatterton
10,561,894 B2 2/2020 Dalebout
10,569,121 B2 2/2020 Watterson
10,569,123 B2 2/2020 Hochstrasser
10,625,114 B2 4/2020 Ercanbrack
10,625,137 B2 4/2020 Dalebout
10,661,114 B2 5/2020 Watterson et al.
10,668,320 B2 6/2020 Watterson
10,671,705 B2 6/2020 Capell et al.
10,688,346 B2 6/2020 Brammer
10,702,736 B2 7/2020 Weston et al.
10,709,925 B2 7/2020 Dalebout et al.
10,726,730 B2 7/2020 Watterson
10,729,965 B2 8/2020 Powell
10,758,767 B2 8/2020 Olson
10,786,706 B2 9/2020 Smith
10,864,407 B2 12/2020 Watterson
10,918,905 B2 2/2021 Powell et al.
10,932,517 B2 3/2021 Ashby et al.
10,940,360 B2 3/2021 Dalebout et al.
10,953,268 B1 3/2021 Dalebout et al.

(56) References Cited

U.S. PATENT DOCUMENTS 10,953,305 B2 3/2021 Dalebout et al.
10,967,214 B1 4/2021 Olson
10,994,173 B2 5/2021 Watterson
11,000,730 B2 5/2021 Dalebout et al.
11,013,960 B2 5/2021 Watterson et al.
11,033,777 B1 6/2021 Watterson et al.
11,058,913 B2 7/2021 Dalebout et al.
11,058,914 B2 7/2021 Powell
11,058,918 B1 7/2021 Watterson et al.
11,187,285 B2 11/2021 Wrobel
2002/0016235 A1 2/2002 Ashby et al.
2002/0077221 A1 6/2002 Dalebout et al.
2002/0128127 A1 9/2002 Chen
2002/0159253 A1 10/2002 Dalebout et al.
2003/0171189 A1 9/2003 Kaufman
2004/0091307 A1 5/2004 James
2004/0127335 A1 7/2004 Watterson et al.
2004/0171464 A1 9/2004 Ashby et al.
2004/0171465 A1 9/2004 Hald et al.
2005/0049123 A1 3/2005 Dalebout et al.
2005/0077805 A1 4/2005 Dalebout et al.
2005/0107229 A1 5/2005 Wickens
2005/0164839 A1 7/2005 Watterson et al.
2005/0272577 A1 12/2005 Olson et al.
2005/0277520 A1 12/2005 Van Waes
2006/0135322 A1 6/2006 Rocker
2006/0217237 A1 9/2006 Rhodes
2006/0240959 A1 10/2006 Huang
2007/0066448 A1 3/2007 Pan
2007/0117683 A1 5/2007 Ercanbrack et al.
2007/0123395 A1 5/2007 Ellis
2007/0197353 A1 8/2007 Hundley
2007/0232463 A1 10/2007 Wu
2007/0254778 A1 11/2007 Ashby
2008/0242520 A1 10/2008 Hubbard
2008/0300110 A1 12/2008 Smith et al.
2009/0105052 A1 4/2009 Dalebout et al.
2010/0242246 A1 9/2010 Dalebout et al.
2010/0317488 A1 12/2010 Cartaya
2011/0131005 A1 6/2011 Ueshima
2012/0237911 A1 9/2012 Watterson
2012/0295774 A1 11/2012 Dalebout et al.
2013/0014321 A1 1/2013 Sullivan
2013/0123083 A1 5/2013 Sip
2013/0165195 A1 6/2013 Watterson
2013/0172152 A1 7/2013 Watterson
2013/0172153 A1 7/2013 Watterson
2013/0178334 A1 7/2013 Brammer
2013/0178768 A1 7/2013 Dalebout
2013/0190136 A1 7/2013 Watterson
2013/0196298 A1 8/2013 Watterson
2013/0196822 A1 8/2013 Watterson et al.
2013/0218585 A1 8/2013 Watterson
2013/0244836 A1 9/2013 Maughan
2013/0267383 A1 10/2013 Watterson
2013/0268101 A1 10/2013 Brammer
2013/0274067 A1 10/2013 Watterson et al.
2013/0281241 A1 10/2013 Watterson
2014/0024499 A1 1/2014 Watterson
2014/0073970 A1 3/2014 Ashby
2014/0121071 A1 5/2014 Strom et al.
2014/0135173 A1 5/2014 Watterson
2014/0274574 A1 9/2014 Shorten et al.
2014/0274579 A1 9/2014 Olson
2014/0287884 A1 9/2014 Buchanan
2014/0309085 A1 10/2014 Watterson et al.
2015/0182781 A1 7/2015 Watterson
2015/0238817 A1 8/2015 Watterson
2015/0250418 A1 9/2015 Ashby
2015/0251055 A1 9/2015 Ashby
2015/0253210 A1 9/2015 Ashby et al.
2015/0253735 A1 9/2015 Watterson
2015/0253736 A1 9/2015 Watterson
2015/0258560 A1 9/2015 Ashby
2015/0367161 A1 12/2015 Wiegardt
2016/0058335 A1 3/2016 Ashby
2016/0059064 A1 3/2016 Smith et al.
2016/0063615 A1 3/2016 Watterson
2016/0092909 A1 3/2016 Watterson
2016/0101311 A1 4/2016 Workman
2016/0107065 A1 4/2016 Brammer
2016/0121074 A1 5/2016 Ashby
2016/0148535 A1 5/2016 Ashby
2016/0148536 A1 5/2016 Ashby
2016/0158595 A1 6/2016 Dalebout
2016/0206248 A1 7/2016 Sartor et al.
2016/0206922 A1 7/2016 Dalebout et al.
2016/0228746 A1* 8/2016 Jayakumar ..... G16H 40/63
2016/0250519 A1 9/2016 Watterson
2016/0253918 A1 9/2016 Watterson
2016/0339298 A1 11/2016 Kats
2016/0346595 A1 12/2016 Dalebout et al.
2016/0346617 A1 12/2016 Srugo et al.
2017/0036053 A1 2/2017 Smith et al.
2017/0056711 A1 3/2017 Dalebout et al.
2017/0056715 A1 3/2017 Dalebout et al.
2017/0056726 A1 3/2017 Dalebout et al.
2017/0124912 A1 5/2017 Ashby et al.
2017/0128769 A1* 5/2017 Long ..... A63B 71/0686
2017/0193578 A1 7/2017 Watterson
2017/0266483 A1 9/2017 Dalebout et al.
2017/0266489 A1 9/2017 Douglass et al.
2017/0266503 A1 9/2017 Watterson et al.
2017/0266532 A1 9/2017 Watterson
2017/0270820 A1 9/2017 Ashby
2018/0001135 A1 1/2018 Powell
2018/0036585 A1 2/2018 Powell
2018/0084817 A1 3/2018 Capell et al.
2018/0085630 A1 3/2018 Capell et al.
2018/0089396 A1 3/2018 Capell et al.
2018/0099116 A1 4/2018 Ashby
2018/0099179 A1 4/2018 Chatterton et al.
2018/0099180 A1 4/2018 Wilkinson
2018/0099205 A1 4/2018 Watterson
2018/0111034 A1 4/2018 Watterson
2018/0117383 A1 5/2018 Workman
2018/0117385 A1 5/2018 Watterson et al.
2018/0117393 A1 5/2018 Ercanbrack
2018/0154207 A1 6/2018 Hochstrasser
2018/0154208 A1 6/2018 Powell et al.
2018/0200566 A1 7/2018 Weston
2019/0058370 A1 2/2019 Tinney
2019/0080624 A1 3/2019 Watterson
2019/0168072 A1 6/2019 Brammer
2019/0178313 A1 6/2019 Wrobel
2019/0192898 A1 6/2019 Dalebout
2019/0192952 A1 6/2019 Powell
2019/0209893 A1 7/2019 Watterson
2019/0223612 A1 7/2019 Watterson
2019/0269971 A1 9/2019 Capell et al.
2019/0275366 A1 9/2019 Powell
2019/0282852 A1 9/2019 Dalebout
2019/0328079 A1 10/2019 Ashby et al.
2019/0329091 A1 10/2019 Powell et al.
2019/0376585 A1 12/2019 Buchanan
2020/0009417 A1 1/2020 Dalebout
2020/0222751 A1 7/2020 Dalebout
2020/0338389 A1 7/2020 Dalebout
2020/0254295 A1 8/2020 Watterson
2020/0254309 A1 8/2020 Watterson
2020/0254311 A1 8/2020 Watterson
2020/0391069 A1 8/2020 Olson
2020/0368575 A1 11/2020 Hays
2021/0001177 A1 1/2021 Smith
2021/0046351 A1 2/2021 Ercanbrack
2021/0046353 A1 2/2021 Dalebout
2021/0086018 A1 3/2021 Dalebout

(56) References Cited

U.S. PATENT DOCUMENTS

| | | | |
|---|---|---|---|
| 2021/0086032 | A1 | 3/2021 | Watterson |
| 2021/0106899 | A1 | 4/2021 | Willardson |

FOREIGN PATENT DOCUMENTS

| | | |
|---|---|---|
| WO | 200914330 | 1/2009 |
| WO | 2017196446 | 11/2017 |

OTHER PUBLICATIONS

U.S. Appl. No. 29/702,127, filed Sep. 16, 2019, ICON Health & Fitness, Inc.
U.S. Appl. No. 13/088,007, filed Apr. 5, 2011, Scott R. Watterson.
U.S. Appl. No. 15/821,386, filed Nov. 22, 2017, ICON Health & Fitness, Inc.
U.S. Appl. No. 15/973,176, filed May 7, 2018, Melanie Douglass.
U.S. Appl. No. 16/378,022, filed Apr. 8, 2019, William T. Dalebout.
U.S. Appl. No. 16/435,104, filed Jun. 7, 2019, Dale Alan Buchanan.
U.S. Appl. No. 16/506,085, filed Jul. 9, 2019, ICON Health & Fitness, Inc.
U.S. Appl. No. 62/697,833, filed Jul. 13, 2018, ICON Health & Fitness, Inc.
U.S. Appl. No. 62/796,952, filed Jan. 25, 2019, ICON Health & Fitness, Inc.
U.S. Appl. No. 62/804,146, filed Feb. 11, 2019, ICON Health & Fitness, Inc.
U.S. Appl. No. 62/804,685, filed Feb. 12, 2019, ICON Health & Fitness, Inc.
U.S. Appl. No. 62/852,118, filed May 22, 2019, David Hays.
U.S. Appl. No. 62/866,576, filed Jun. 25, 2019, ICON Health & Fitness, Inc.
U.S. Appl. No. 62/887,391, filed Aug. 15, 2019, ICON Health & Fitness, Inc.
U.S. Appl. No. 62/887,398, filed Aug. 15, 2019, ICON Health & FItness, Inc.
U.S. Appl. No. 62/897,113, filed Sep. 9, 2019, ICON Health & Fitness, Inc.
U.S. Appl. No. 62/842,118, filed May 23, 2019, ICON Health & Fitness, Inc.
U.S. Appl. No. 62/912,451, filed Sep. 9, 2019, Megan Jane Ostler.
U.S. Appl. No. 29/702,127, filed Sep. 16, 2019, Gordon Cutler.
U.S. Appl. No. 63/073,081, filed Sep. 1, 2020, Darren C. Ashby.
U.S. Appl. No. 17/014,935, filed Sep. 8, 2020, Megan Jane Ostler.
U.S. Appl. No. 63/079,697, filed Sep. 17, 2020, Jared Willardson.
U.S. Appl. No. 63/086,793, filed Oct. 2, 2020, Darren C. Ashby.
U.S. Appl. No. 17/066,485, filed Oct. 9, 2020, Jared Weston.
U.S. Appl. No. 17/096,350, filed Nov. 12, 2020, William T. Dalebout.
U.S. Appl. No. 17/141,880, filed Jan. 5, 2021, Wade A. Powell.
U.S. Appl. No. 63/134,036, filed Jan. 5, 2021, Gaylen Ercanbrack.
U.S. Appl. No. 17/149,299, filed Jan. 14, 2021, William T. Dalebout.
U.S. Appl. No. 17/159,814, filed Jan. 27, 2021, William T. Dalebout.
U.S. Appl. No. 17/172,880, filed Feb. 10, 2021, Darren C. Ashby.
U.S. Appl. No. 63/150,066, filed Feb. 16, 2021, Kent M. Smith.
U.S. Appl. No. 17/178,173, filed Feb. 17, 2021, Evan Charles Tinney.
U.S. Appl. No. 63/156,801, filed Mar. 4, 2021, Eric S. Watterson.
U.S. Appl. No. 17/204,704, filed Mar. 17, 2021, Chris Nascimento.
U.S. Appl. No. 17/209,714, filed Mar. 23, 2021, Chase Brammer.
U.S. Appl. No. 63/165,498, filed Mar. 24, 2021, Mark Archer.
U.S. Appl. No. 63/200,903, filed Apr. 2, 2021, Eric S. Watterson.
U.S. Appl. No. 17/217,938, filed Apr. 8, 2021, Eric S. Watterson.
International Search Report issued in PCT/US17/23002 dated Jun. 28, 2017.
U.S. Appl. No. 62/310,503, filed Mar. 18, 2016, titled "Coordinated Weight Selection"; 29 pages.
U.S. Appl. No. 16/299,688, filed Mar. 12, 2019 titled: "Coordinated Weight Selection"; 29 pages.
Korean Intellectual Property Office; International Search Report and Written Opinion issued in PCT/US17/22989 dated May 23, 2017, 12 pages.
Octane Fitness; "Consumer Adapter Kit for Cross Circuit Pro—Safety and Assembly Instructions"; Instruction Manual; 2011; 4 pages; located at: https://www.octanefitness.com/home/wp-content/uploads/sites/2/2014/01/106082-001-REV-A-INSTRUCTIONS-CONSUMER-ADAPTER-FOR-CCPRO-2.22.11.pdf.
Octane Fitness; Cross Circuit Pro Kit—XT One Assembly & Set-Up Instructions; Instruction Manual; 2016; 20 pages; located at: https://www.octanefitness.com/wp-content/uploads/2016/11/110786-001-REV-C-INSTRUCTIONS-CROSS-CIRCUIT-PRO-XT-ONE-UnR.pdf.
Octane Fitness; Product Programs and Features; Instruction Manual; 2017; 56 pages; located at: https://www.octanefitness.com/home/wp-content/uploads/sites/2/2017/04/110751-001-REV-E-PROGRAMS-FEATURES-COMM-ENG.pdf.
Octane Fitness; Octane Fitness Cross Circuit; Webpage; accessed on Nov. 30, 2018; located at: https://www.octanefitness.com/commercial/cross-circuit/.
U.S. Appl. No. 62/336,567, filed May 13, 2016, titled "Weight Platform Treadmill".

* cited by examiner

TREADMILL CONFIGURED TO AUTOMATICALLY DETERMINE USER EXERCISE MOVEMENT

CROSS-REFERENCE TO RELATED APPLICATIONS

This application is a continuation of U.S. patent application Ser. No. 16/378,022, filed on Apr. 8, 2019, which is a continuation of U.S. patent application Ser. No. 15/461,246, filed on Mar. 16, 2017, now U.S. Pat. No. 10,252,109, which claims priority to U.S. Provisional Patent Application No. 62/336,567, filed on May 13, 2016. Each of these applications is incorporated herein by reference in its entirety.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among other activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user uses an aerobic exercise machine to perform an aerobic workout indoors. One type of aerobic exercise machine is a treadmill, which is a machine that has a running deck attached to a support frame. The running deck can support the weight of a person using the machine. The running deck incorporates a tread belt that is driven by a motor. A user can run or walk in place on the tread belt by running or walking at the tread belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical machines, rowing machines, stepper machines, and stationary bikes to name a few.

One type of treadmill is disclosed in U.S. Pat. No. 4,729,558 issued to Hai P. Kuo. In this reference, an improved running exerciser comprises a base frame having a first shaft and second shaft, a pair of inverted U-shaped members each mounted at one side of the base frame, a track in the form of endless loop around the first shaft and the second shaft, a pulley fastened on one end of the first shaft, a motor assembly having a tubular rod enclosing the first shaft, a pair of conical clutch discs put over a driving shaft of the motor assembly, a belt connecting the pulley to the clutch discs, a speed control mechanism mounted on one of the inverted U-shaped members for regulating speed of the track, and a stand for lifting a front end of the base frame to incline the endless loop to form a slope.

SUMMARY

In some embodiments, a treadmill may include a deck, a first pulley disposed in the deck, a second pulley disposed in the deck, a tread belt surrounding the first pulley and the second pulley, an electronic sensor incorporated into the treadmill and configured to automatically produce measurement data in response to exercise movement performed by a user over the deck, an electronic console including an electronic display, a processor, and a memory. The memory may include programmed instructions that, when executed, cause the processor to automatically analyze the measurement data produced by the electronic sensor to automatically determine a characteristic of the exercise movement performed by the user over the deck, and automatically present, on the electronic display, an indication of the characteristic of the exercise movement performed by the user over the deck.

In some embodiments, the characteristic of the exercise movement performed by the user over the deck may include a repetition count in the exercise movement performed by the user over the deck. In these embodiments, the repetition count may be of a weight lifting exercise movement, a military press exercise movement, a curl exercise movement, a jumping exercise movement, a push-up exercise movement, a leg lift exercise movement, or a sit-up exercise movement.

In some embodiments, the characteristic of the exercise movement performed by the user over the deck may include a type of exercise performed by the user in the exercise movement performed by the user over the deck. In these embodiments, the type of exercise may include a weight lifting exercise, a military press exercise, a curl exercise, a jumping exercise, a push-up exercise, a leg lift exercise, or a sit-up exercise.

In some embodiments, the electronic sensor may include an accelerometer, an optical sensor, a laser displacement sensor, a camera, a capacitance sensor, a strain gauge, or a geophone.

In some embodiments, the electronic sensor may be incorporated into the electronic console.

In some embodiments, the electronic sensor may be incorporated into the deck.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

Figure 1:
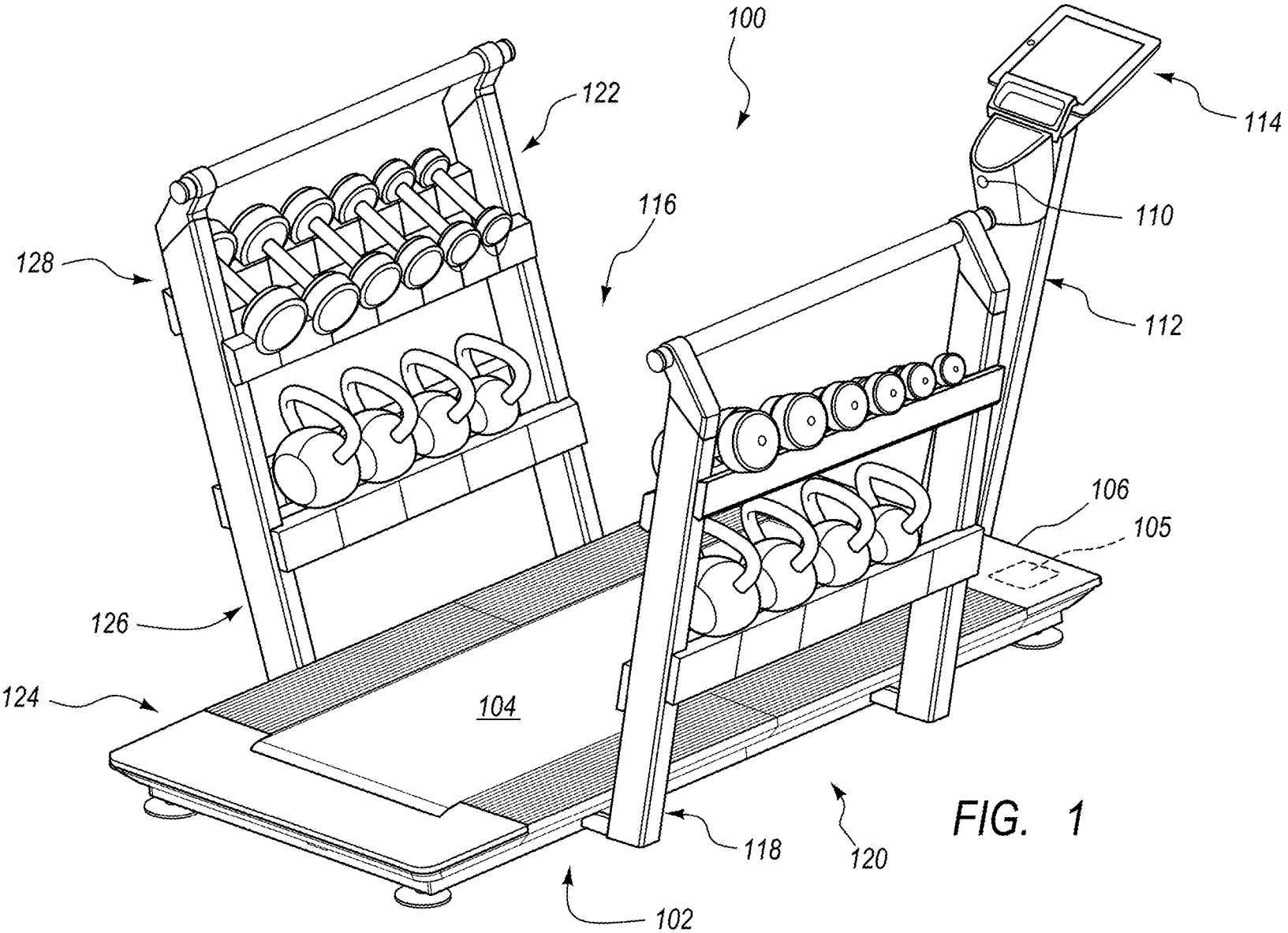
FIG. 1 illustrates a perspective view of an example of a treadmill in accordance with the present disclosure.

Particularly, with reference to the figures, FIG. 1 depicts an example of a treadmill 100 having a deck 102 with a first pulley disposed in a first portion of the deck 102 and a second pulley incorporated into a second portion of the deck 102. A tread belt 104 surrounds the first pulley and the second pulley. A motor 105 is in mechanical communication with either the first pulley or the second pulley. A cover 106 is superjacent the motor 105. A scale mechanism is incorporated into the deck 102, and a repetition counter 110 is also incorporated into the treadmill.

The treadmill 100 also includes an upright portion 112 that supports a console 114. In this example, the repetition counter 110 is incorporated into the upright portion 112. In this example, the scale mechanism is obscured from view, but is incorporated into the cover 106 near the base of the upright portion 112.

Also incorporated into the treadmill 100 is a free weight rack 116. In this example, a first portion 118 of the free weight rack 116 is connected to a first side 120 of the deck 102, and a second portion 122 of the free weight rack 116 is connected to a second side 124 of the deck 102. The free weight rack 116 may include multiple tiers. In this example, each of the portions of the free weight rack 116 include a first tier 126 and a second tier 128. In some cases, each of the tiers include a cross member that includes features that prevent the free weights from slipping off of the rack. For example, the feature may include a lip, a recess, another type of feature, or combinations thereof.

Figure 2:
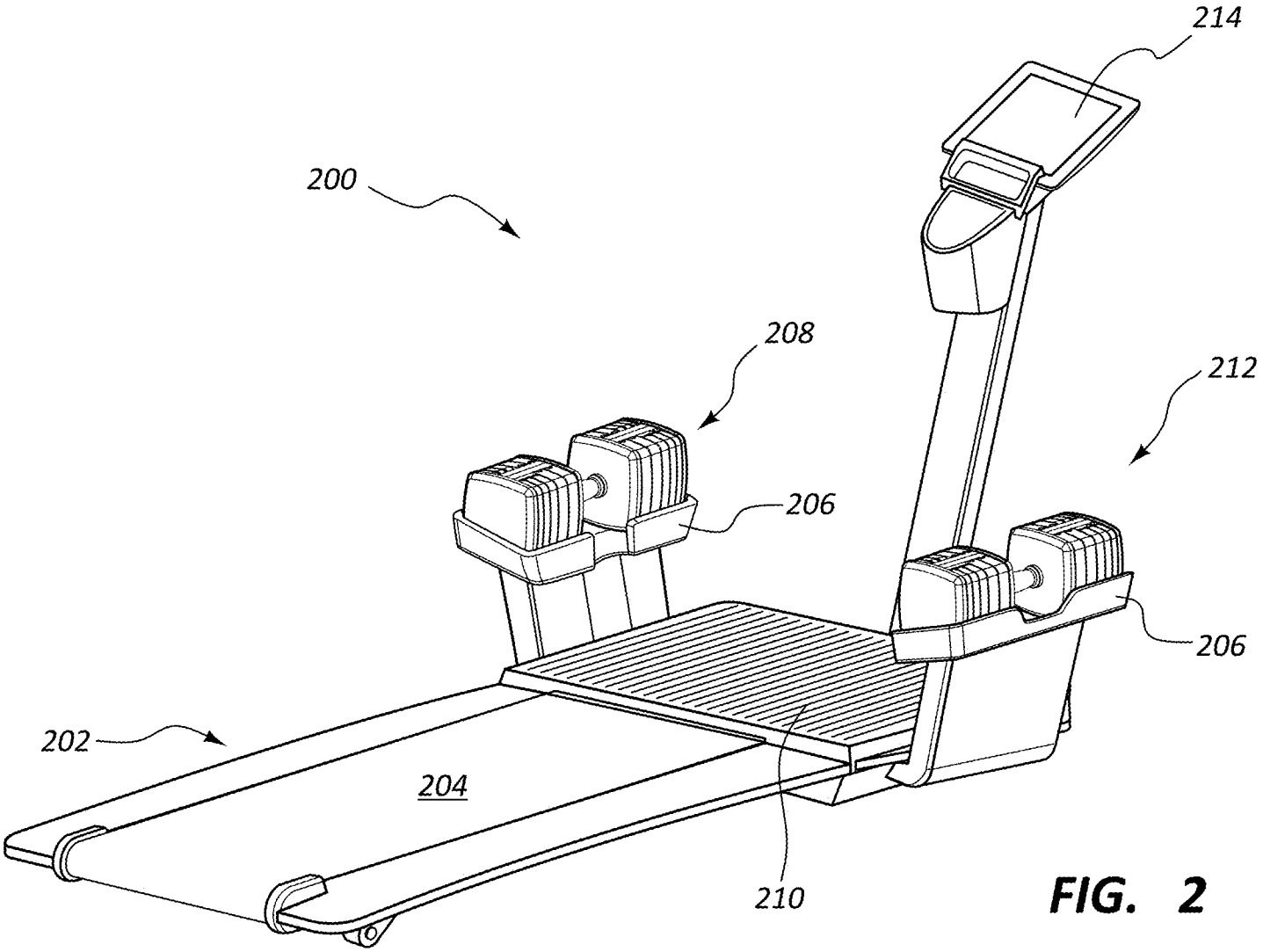
FIG. 2 illustrates a perspective view of an example of a treadmill in accordance with the present disclosure.

FIG. 2 depicts an example of a treadmill 200. In this example, the treadmill 200 includes a deck 202, and a tread belt 204 that surrounds a first pulley and second pulley incorporated into the deck 202. A free weight rack 206 is also incorporated into the treadmill 200. In this example, the free weight rack 206 includes a single tier and supports an adjustable dumbbell 208.

A weight scale 210 is incorporated into the deck 202 at a front end 212 of the treadmill 200. In this example, the weight scale 210 is positioned over the motor that drives the first pulley and therefore drives the tread belt 204. As a user stands on the weight scale 210, the weight of the user can be presented in the console 214, in a display incorporated into the weight scale 210, in a mobile device, or in another computing device in communication with the weight scale, or combinations thereof. Additionally, when the user lifts the free weights off of the free weight rack 206, the weight scale measures the combined weight of the user and the free weights. In some cases, the dynamic fluctuation of the weight scale's measurements that occur as the user performs an anaerobic exercise with the free weights is used by the repetition counter to determine how many lifts the user has performed.

Figure 3:
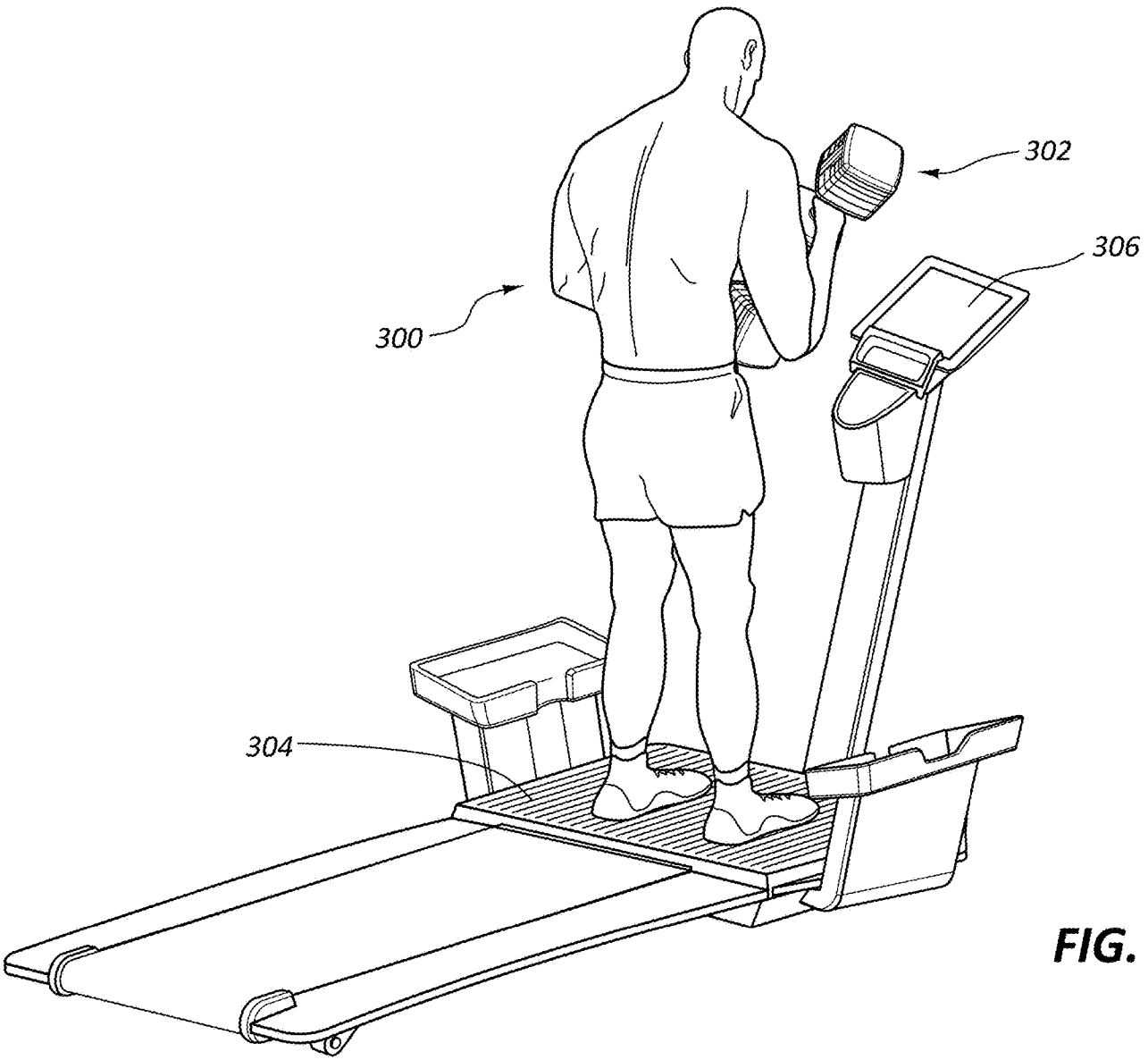
FIG. 3 illustrates a perspective view of an example of a treadmill in accordance with the present disclosure.

FIG. 3 depicts an example of a user 300 performing an anaerobic workout with the free weights 302 on the weight scale 304. In this situation, the dynamic fluctuation of the weight scale's measurements while the user performs lifts with the free weights is used by the repetition counter to determine how many lifts the user has performed. In this example, the amount of weight lifted by the user 300 is depicted in the console 306.

Figure 4:
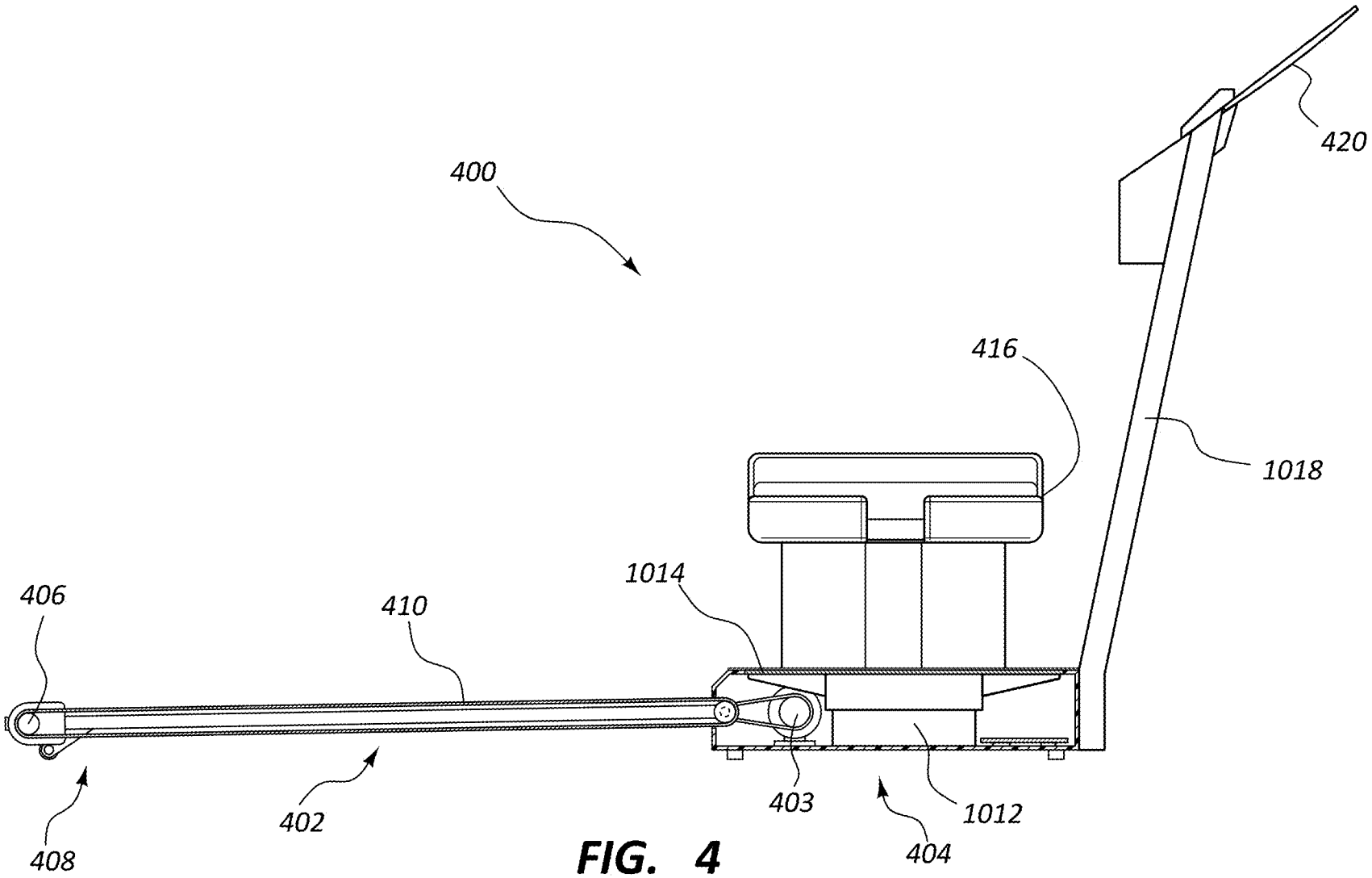
FIG. 4 illustrates a cross sectional view of an example of a treadmill in accordance with the present disclosure.

FIG. 4 depicts a cross sectional view of a treadmill 400. In this example, the treadmill 400 includes a deck 402 with a first pulley 403 in a first portion 404 of the deck 402 and a second pulley 406 in a second portion 408 of the deck. A tread belt 410 surrounds the first pulley 403 and the second pulley 406. A motor 412 drives the first pulley 403 to move the tread belt 410. A weight scale 414 is positioned over the motor 412. A rack 416 is attached to the deck 402 adjacent to the weight scale 414. An upright portion 418 of the treadmill 400 is attached to the deck 402, and a console 420 is attached to the upright portion 418.

Figure 5:
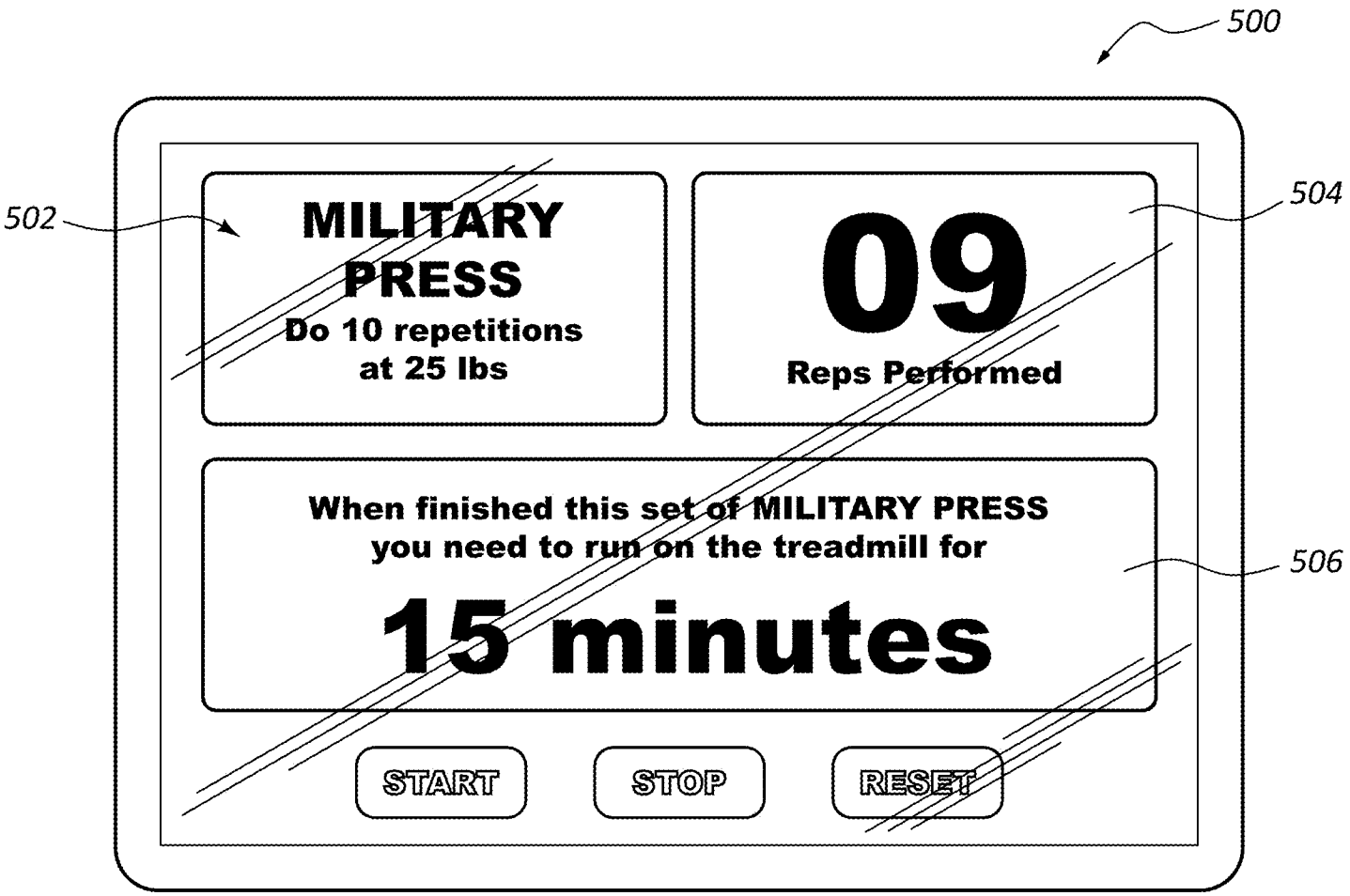
FIG. 5 illustrates a view of an example of display incorporated into an exercise device in accordance with the present disclosure.

FIG. 5 depicts an example of a display 500 incorporated into a console of an exercise device. The exercise device may be like the exercise device depicted in the other figures that incorporate a weight scale. In this example, the display includes instructions 502 to perform a certain type of lift, including the weight amount to be lifted and the number of repetitions. The display 500 also includes a repetition counter 504, which presents the number of repetitions that the user has already performed. The display 500 also includes instructions 506 for what the user is to do after the anaerobic exercise is completed. In this case, the instructions includes running on the treadmill for 15 minutes.

Figure 6:
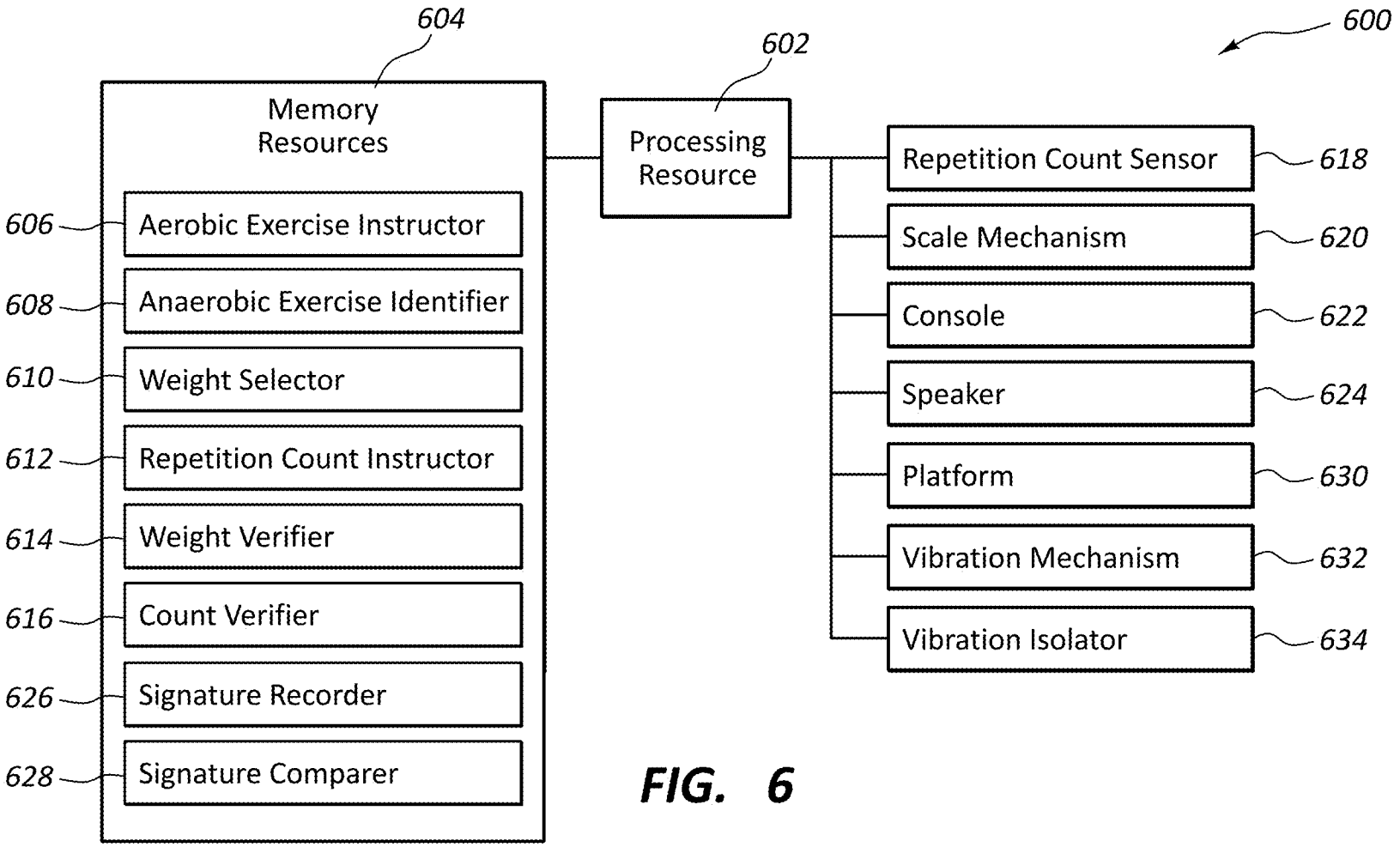
FIG. 6 illustrates a perspective view of an example of an instruction system incorporated into an exercise device in accordance with the present disclosure.

FIG. 6 depicts an example of an instruction system 600. In this example, the instruction system 600 includes processing resources 602, such as a processor, and memory resources 604, such as memory. The memory resources 604 may cause the processing resources 602 to carry out functions programmed in the memory resources 604. In this example, the memory resources 604 include an aerobic exercise instructor 606, an anaerobic exercise instructor 608, a weight selector 610, a repetition count instructor 612, a weight verifier 614, a count verifier 616 signature recorder 626, and signature comparer 628. Further, the processing resources 602 may be in communication with a repetition count sensor 618, a scale mechanism 620, a console 622, a speaker 624, platform 630, vibration mechanism 632, vibration isolator 634, and/or combinations thereof.

Figure 7:
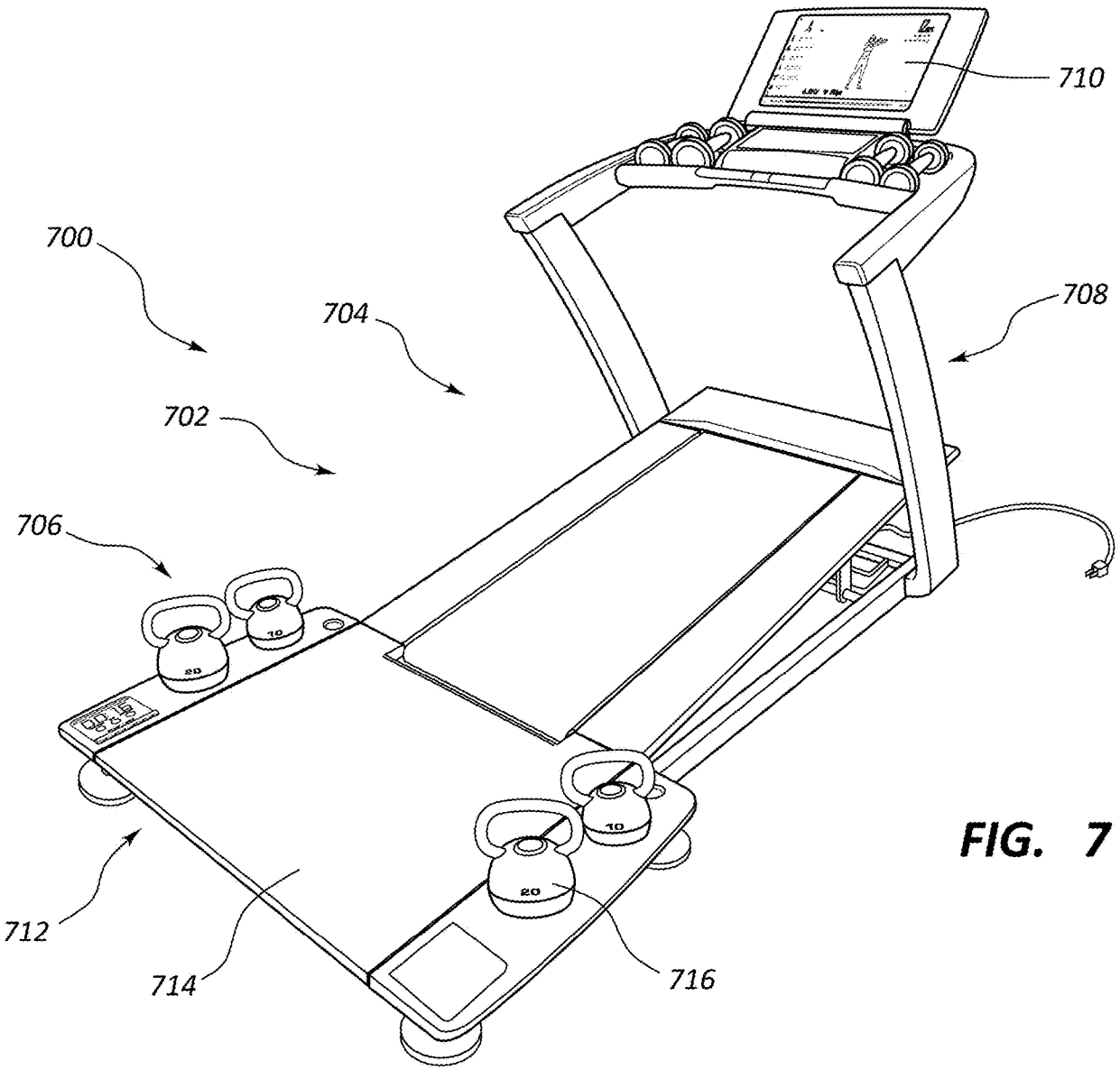
FIG. 7 illustrates a perspective view of an example of a treadmill incorporated into an exercise device in accordance with the present disclosure.

FIG. 7 depicts an example of a treadmill 700 with a deck 702. The deck 702 includes a first pulley in a first portion 704 and a second pulley in a second portion 706. A tread belt surrounds the first pulley and the second pulley. The treadmill 700 also includes an upright structure 708, and a display 710 connected to the upright structure 708.

The deck 702 also includes a platform 712. The platform 712 includes a vibration mechanism that causes the top surface 714 of the platform 712 to vibrate. Free weights 716, such as dumbbells, kettlebells, or other types of weights, may be positioned adjacent to the top surface 714 to be within a convenient reach of the user. The user may use the weights to perform an anaerobic exercise on the platform. The anaerobic exercise may constitute the entire exercise routine. In other examples, the anaerobic exercise may constitute a portion of the exercise routine. In some cases, the exercise routine includes anaerobic components and aerobic components. The aerobic components of the exercise may include exercises that are performed on the tread belt of the deck.

Figure 8:
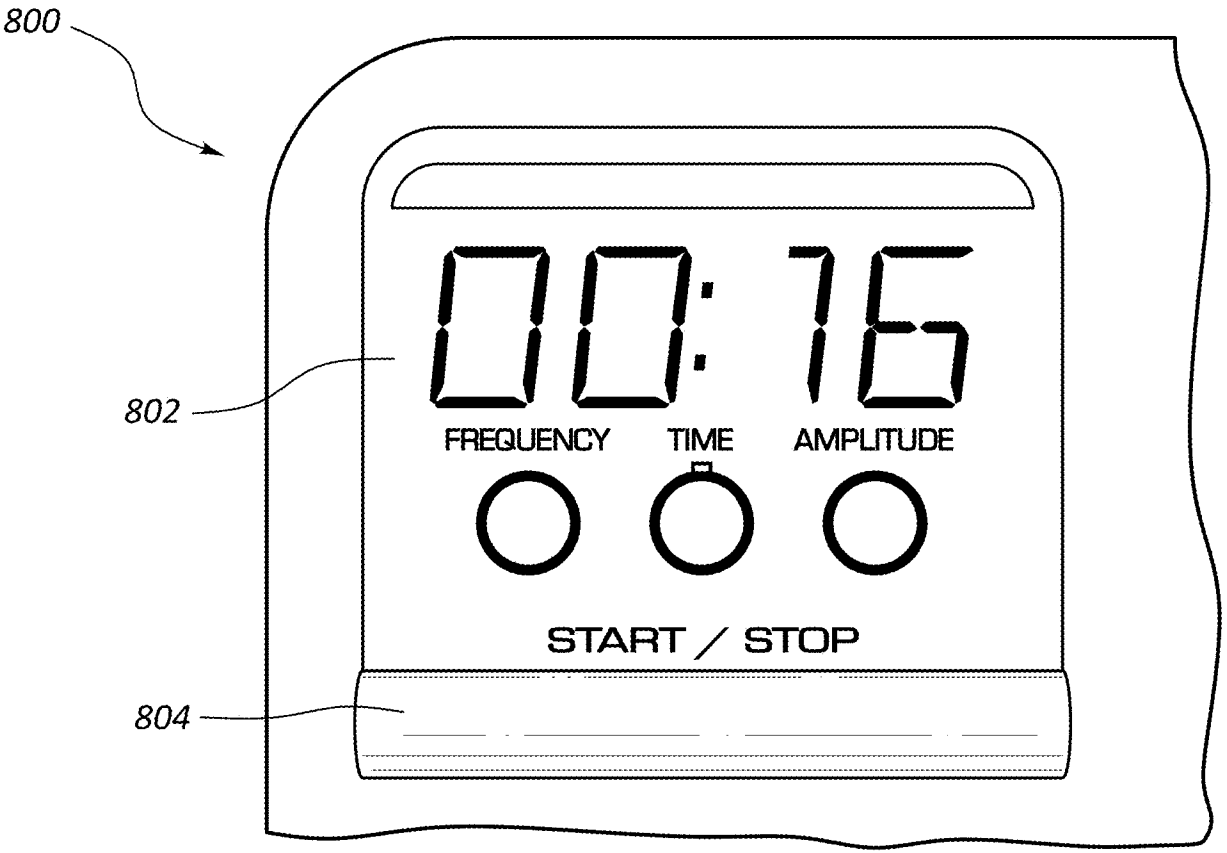
FIG. 8 illustrates a perspective view of an example of a display incorporated into an exercise device in accordance with the present disclosure.

FIG. 8 is a display 800 that is incorporated into the treadmill. In some examples, the display 800 is incorporated into the upright structure. In yet other examples, the display 800 is incorporated into the deck, such as into the platform.

The display 800 may include a field 802 that depicts different parameters about the user's workout on the platform. For example, the field may depict a vibration amplitude, a time duration of the workout, or a frequency of the vibration. In some cases, just one of the parameters is depicted at a time. In other examples, at least two of the parameters are depicted in the display simultaneously.

An input mechanism 804 may be proximate the display 800. The input mechanism 804 may be a push button, a touch screen input, a level, a dial, a switch, a microphone, another type of input mechanism, or combinations thereof.

Figure 9:
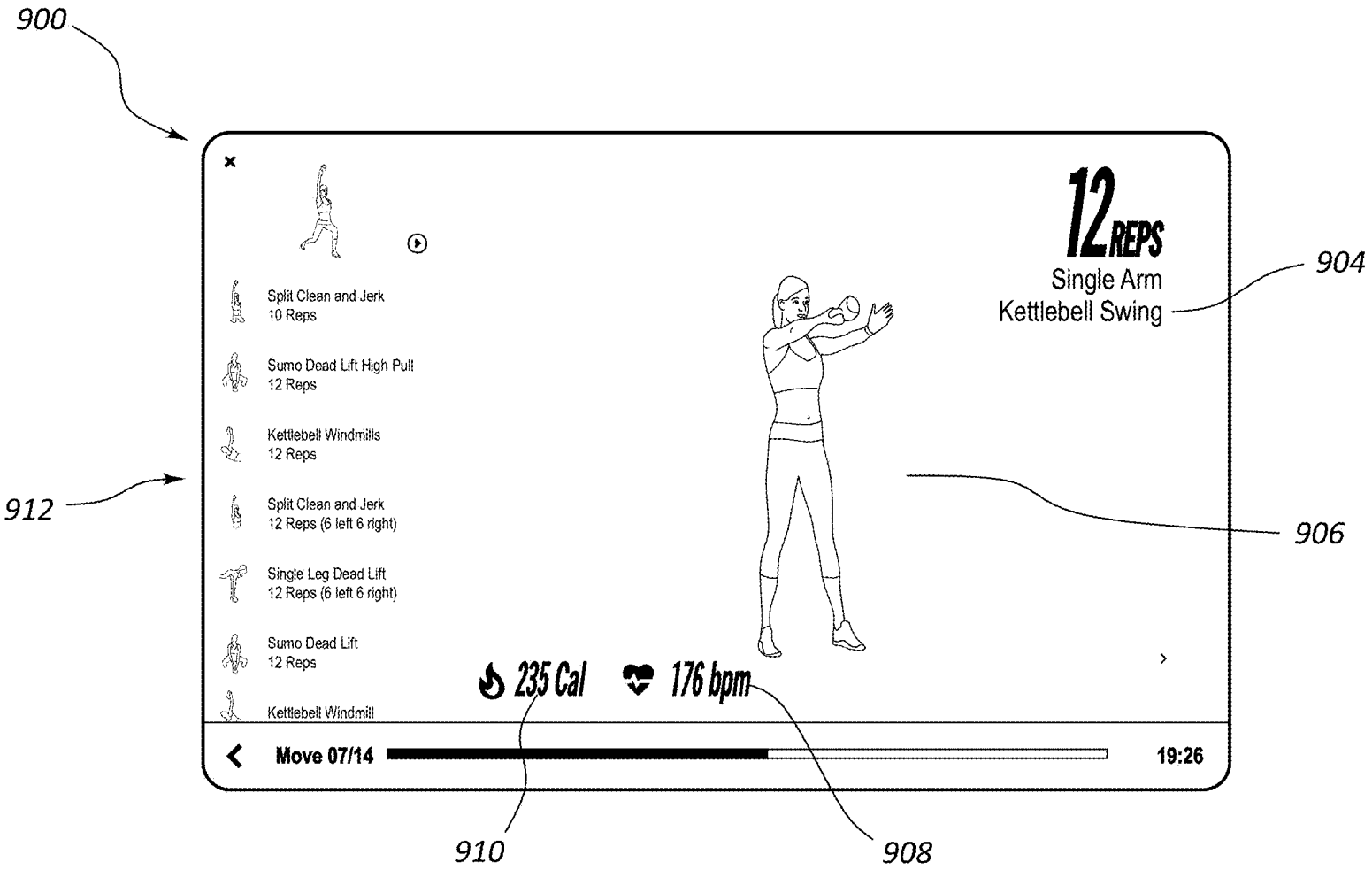
FIG. 9 illustrates a perspective view of an example of a display incorporated into an exercise device in accordance with the present disclosure.

FIG. 9 depicts another example of a display 900 incorporated into the treadmill. In this example, the display 900 is connected to the upright structure that is attached to the deck. In this example, the display 900 includes a repetition count 902, a name 904 of the exercise type, an image 906 of the how the exercise type is performed (e.g. visual instructions on performing the exercise type), a heart rate 908, a calorie count 910, and a routine sequence 912. The routine sequence 912 includes the types of exercises that are coming up next in the exercise routine and the number of repetitions to perform. In some examples, the display may include a video segment and an audio segment that describes how the exercise is to be performed.

Figure 10:
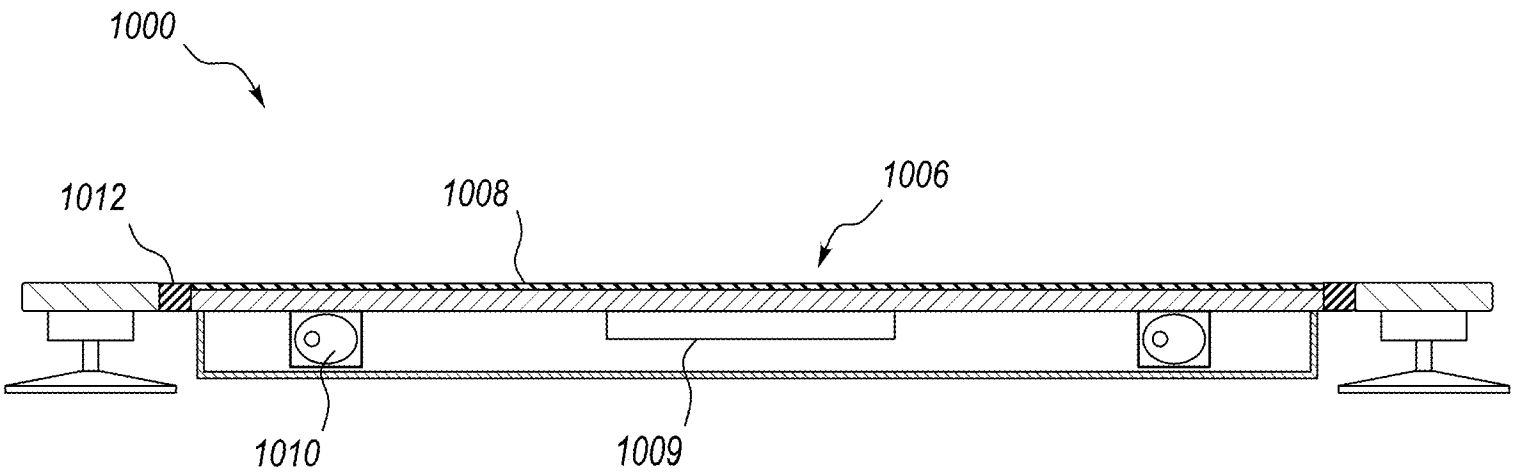
FIG. 10 illustrates a cross sectional view of an example of a platform incorporated into an exercise device in accordance with the present disclosure.

FIG. 10 depicts an example of a treadmill 1000. In this example, the treadmill 1000 includes a platform 1006 adjacent to the tread belt. The platform 1006 includes a top plate 1008 that is connected to a vibration mechanism 1010. The vibration mechanism 1010, when activated, can vibrate the top plate 1008. Additionally, the platform 1006 may include at least one vibration isolator 1012 that at least mitigates the strength of the vibrations as the vibrations pass from the platform to the other portions of the deck, the upright structure, the display, other components of the treadmill, or combinations thereof. In some examples, the at least one vibration isolator 1012 eliminates vibrations from passing from the platform to the other components of the treadmill.

In this example, the vibration mechanism 1010 includes a camming mechanism where a cam has an eccentric mass. As the eccentric mass rotates about an axle, the rotation generates a vibration in the top plate 1008.

Figure 11:
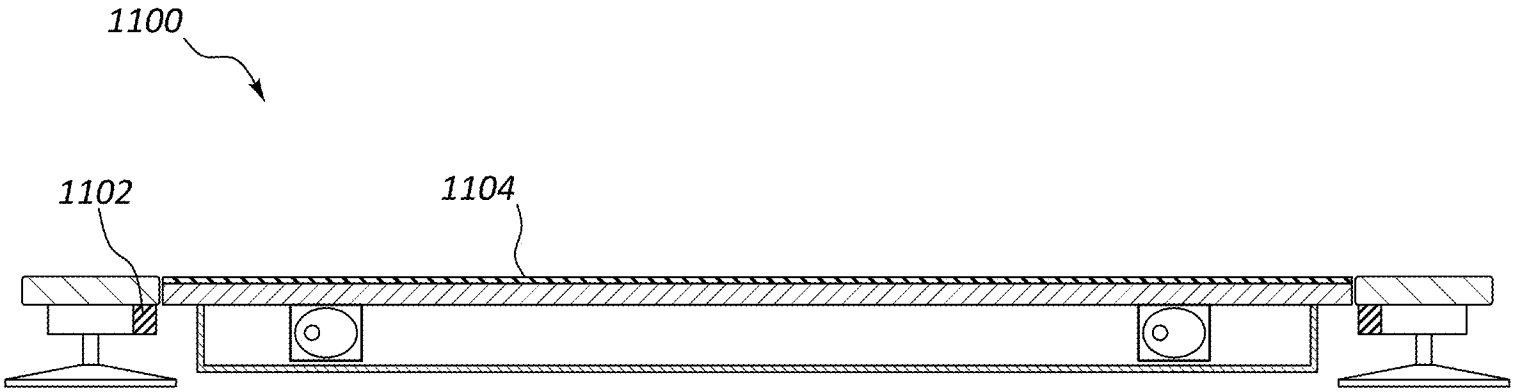
FIG. 11 illustrates a cross sectional view of an example of a platform in accordance with the present disclosure.

FIG. 11 depicts an example of a treadmill 1100. In this example, at least one vibration isolator 1102 is an active vibration isolator that detects a vibration and then actively imposes a cancelation wave that cancels the vibrations that could be potentially transmitted to the other portions of the treadmill 1100. In this example, the at least one vibration isolator 1102 is attached to components of the treadmill 1100 that are off of the platform's top plate 1104.

General Description

In general, the invention disclosed herein may provide a user with a treadmill that has several advantages over conventional treadmills. The treadmill may include a running deck that has first pulley and a second pulley. A tread belt may surround the first and second pulley. A motor can be attached to either the first or the second pulley so that as the motor rotates its shaft, the connected pulley also rotates which drives movement of the tread belt. In those examples where the treadmill includes just a single motor, the movement of the tread belt drives movement of the other pulley that is not connected to the motor. A user may perform aerobic exercises on the tread belt, such as walking, running, cycling, or another type of aerobic exercise.

The treadmill may also include a platform where the user may perform anaerobic exercises. Free weights or other types of weights that can be used to perform the anaerobic exercises may be positioned on the platform or at least proximate the platform so that the weights are conveniently accessible to the user while standing on the platform. In some cases, the platform includes a top plate on which the user can exercise and at least one weight rack that is separate from the top plate.

In some cases, a free weight rack may be incorporated into the treadmill. In this example, the free weight rack may have a first portion incorporated into a first side of the treadmill and a second portion incorporated into a second side of the treadmill. Each of the portions of the free weight rack may position the free weights within a convenient reach of each of the user's hands. Thus, the free weights may be accessible to the user when the user is on the exercise deck.

For purposes of this disclosure, the term "free weight" refers broadly to free weights that are intended to be used to execute lifts associated with strength training. In some cases, the free weights may be intended to be held in a single hand where free weights for a first hand are positioned in the first portion 118 of the free weight rack 116, and free weights intended for the second hand are positioned in the second portion 122 of the free weight rack 116. These free weights may include dumbbells, kettlebells, balls, adjustable dumbbells, weight plates, Bulgarian bags, other types of weighted bags, barbells, curl bars, other types of free weights, or combinations thereof.

In some cases, the user can work out on the portion of the exercise deck that includes the tread belt. In this example, the user may desire to mix up the anaerobic exercise and aerobic exercise portions of his or her workout. During the anaerobic portions of the workout, the tread belt may be stopped while the user performs the free weight exercises. When the anaerobic portion of the workout is completed, the user may resume the operation of the tread belt to perform an aerobic portion of the workout. In other examples, the user may want to use the free weights while the tread belt is in operation. For example, the user may want to carry dumbbells during a run.

In other examples, the treadmill incorporates a separate area on the exercise deck where the user can perform exercises with the free weights. In some cases, this free weight area may be in the front end of the treadmill proximate the treadmill's upright portion. A console supported by the upright portion can provide information about the user's workout such as the time, distance, and speed at which the user executed the aerobic portions and the anaerobic portions of the workout.

In some examples, the platform includes a vibration mechanism, a weight scale, another feature, or combinations thereof. In examples with the vibration mechanism, the vibration mechanism may be used to vibrate a top plate of the platform. The vibrations may provide multiple benefits. One benefit is that the vibrations cause the user to work harder while performing an anaerobic exercise. The vibrations therefore increase the number of calories burned and stimulate additional stabilization muscles during the anaerobic portion of the workout.

In some examples, the vibration mechanism includes a camming mechanism where a cam has an eccentric mass. As the eccentric mass rotates about an axle, the rotation generates a vibration in the top plate. The eccentric mass may include any appropriate type of shape. While these examples have been described with the vibration mechanism including a camming mechanism, any appropriate type of vibration mechanism may be used in accordance with the principles described in the present disclosure.

The vibrations also provide a benefit for determining at least one parameter of the user's workout. For example, a vibration sensor may be used to measure the vibrations of the top plate when the user is on the top plate to determine the user's weight, the amount of weight being used by the user, the type of exercise being performed by the user, a repetition count of the exercise, another type of exercise, or combinations thereof. In some examples, the vibration sensor may include an accelerometer, a multi-axis accelerometer, a distance sensor, an optical sensor, a laser displacement sensor, a velocity sensor, a capacitance sensor, a proximity probe, a magnet, a piezoelectric device, a potentiometric sensor, a strain gauge, a geophone, another type of sensor, or combinations thereof.

In some examples, the vibration sensor may be used to determine a baseline measurement. The baseline measurement may be the vibrations recorded by the sensor when the plate is vibrating, but the user and other objects are not on the top plate of the platform. In other examples, the baseline measurement may be a vibration signature that was recorded on a different treadmill with a platform. The baseline measurement may have a unique baseline signature that can be compared to other vibration signatures. In some examples, the baseline signature has a consistent amplitude and frequency.

The baseline measurement may be compared to vibration measurements taken when the user is performing an anaerobic exercise on the platform. For instance, when the user is standing on the platform while the platform is vibrating, the vibration signature will be different than the baseline signature. The user's weight affects the signature's amplitude. In those situations where the user is not moving while standing on the vibrating top plate, the signature may also have a consistent amplitude and frequency. The comparison of the vibration signature and the baseline signature can identify the amount of weight on the top plate.

In those situations where the user picks up a free weight, the additional weight of the free weight will further affect the vibration signature. Thus, the vibration signature can identify the combined weight of the user and the free weigh. During the anaerobic portion of the workout, the user will pick up and return the free weights. In those moments where the user is not holding a weight, the vibration signature can be compared with the baseline to determine the user's weight. In some examples, the treadmill may provide instructions for the user to stand still on the vibration plate to determine the user's weight before instructing the user to lift weights. In other examples, the treadmill determines the user's weight by determining the amount of weight on the top plate throughout the exercise routine. As a result, the vibration signature includes moments where the user is holding additional weight and moments where the user is not holding additional weight. In some examples, the treadmill identifies those characteristics of the vibration signature that depict a consistent vibration reading that indicates the lowest weight on the treadmill to determine the user's baseline weight. With the baseline weight, the treadmill can determine the amount of weight being held by the user at any given time during the anaerobic workout.

As the user performs anaerobic exercises on the platform, the user's movements may also affect the vibration signature when the vibration mechanism is active. For example, when the user lifts a weight, the acceleration of the weight's movement may momentarily increase the load on the top plate, which can affect the amplitude of the vibration signature at that moment. This change in the vibration signature may be time stamped and classified as a lift. Each event in the vibration signature with these types of characteristics may also be classified as a lift. To determine the repetition count, the treadmill or processor may count these types of events, such as the number of times when the amplitude changes in the vibration signature. In examples where these events are time stamped, the user's lift rate can be determined.

Additionally, certain movements performed on the top plate may create different patterns in the vibration signature. These patterns may be distinct for certain a types of exercises. As a result, the type of exercise being performed by the user may be distinguished from other types of exercises. For example, performing a military press exercise may generate a different vibration pattern than performing a lung exercise, a curl exercise, a jumping exercise, a push-up exercise, leg lift exercise, a sit-up exercise, another type of exercise, or combinations thereof.

In some examples, the type of exercise is determined by factors other than the vibration signature. In some instances, the treadmill may instruct the user to perform a certain type of exercise. In these examples, the treadmill may determine that the type of exercise instructed to be performed is the exercise being performed by the user. In other examples, a camera is in communication with the treadmill where the user is in the camera's field of view. An analysis may be performed on the footage captured by the camera to determine the type of exercise performed by the user. In yet other examples, the top plate may include a load cell, a scale, a level, or another type of sensor that detects the location of a load on the top plate. While the user may perform many types of exercises in a central region of the top plate, other types of exercises, such as push-ups and sit-ups may load the top plate asymmetrically. This asymmetric loading may be used to determine the exercise type.

While the examples above have been described with reference to how anaerobic exercises affect the amplitude of a vibration signature, the performance of anaerobic exercises may affect the vibration signature in other ways. For example, certain movements on the top plate may generate a different vibration frequency than the vibration frequency imposed by the vibration mechanism. This distinct vibration frequency may increase or decrease the vibration frequency imposed by the vibration mechanism. Additionally, these user imposed vibrations may cause vibrations imposed by the vibration mechanism to cancel, diminish, amplify, or change in another detectable way.

Any appropriate number of vibration sensors may be used in accordance with the principles described in the present disclosure. For example, a vibration sensor may be attached to each corner of the top plate. In other examples, a single sensor is attached to a single side of the top plate. In yet another example, a single sensor is attached to a central region of the top plate. In some cases, the sensor is attached to a top surface of the plate, an underside of the plate, proximate the plate, another location, or combinations thereof. For example, a vibration sensor 1009 may be attached to an underside of the top plate 1008 of the platform 1006 of the treadmill 1000 of FIG. 10.

Further, in some cases, no vibration mechanism is used to impose a vibration on the top plate. The user's movements while performing the anaerobic exercise may generate vibrations in the top plate that can determine parameters about the user's workout, such as the amount of weight added, the type of exercise being performed, the repetition count of the exercise, another type of parameter of the exercise, or combinations thereof.

In some examples, a display is connected to the treadmill. In some instances, the display may provide information, including information about instructions to the user on which exercise to perform, how to perform each exercise, the repetition count, other information relating the anaerobic portion of the workout, or combinations thereof.

The treadmill may also be in communication with a remote device over a network, such as the internet. The user may access the records of his or her exercise history, previous workouts, exercise recommendation, personal information, or combinations thereof. The remote device may record the workout information and/or the physiological information associated with the workout. An example of a user program that may be compatible with the principles described herein can be found at www.ifit.com, which is administered through Icon Health and Fitness, Inc. located in Logan, Utah, U.S.A.

In some examples, the top plate is vibrationally isolated from other components of the treadmill. Vibration isolators may be used to cancel, reduce, and/or eliminate vibrations from the top plate to other portions of the treadmill. In those examples where the platform is included in a rear portion of the treadmill, the vibration isolators may cancel, reduce, and/or eliminate vibrations from passing from the platform into the rear portion of the treadmill, which also protects the front portion of the treadmill, including the upright structure, and the display and other electronics attached to the upright structure, from the vibrations. Further, in those examples where the platform is located in a front portion of the treadmill, the vibration isolators may protect the front portion, which protects the rear portion, and protect the upright structure from the platform's vibrations.

A passive vibration isolator may be used to reduce and/or eliminate vibrations from passing to other components of the treadmill. In some examples, the passive vibration isolators may include an elastomeric material that connects the top plate and/or the platform to other components of the treadmill. The elastomeric material may include rubber.

Another type of passive vibration isolator may include pneumatic, air, or hydraulic bladder, canister, or other types of containers. These bladders or canister may include a compressed air and/or liquid. In some cases, the pressure is maintained with a source that continuously feeds the bladder and/canister. In some examples, the passive isolator may include an air spring in the form of a rubber bladder which provides damping.

In other examples, the isolators may include mechanical springs and/or spring-dampers. Pads or sheets of flexible materials such as elastomers, rubber, cork, dense foam, laminate materials, other types of material, or combinations thereof may also be used as vibration isolators. Elastomer pads, dense closed cell foams, laminate materials, molded and bonded rubber, elastomeric isolators and mounts, or combinations thereof may also be used. In some cases, the isolators are made of layers of neoprene and steel with a low horizontal stiffness.

In some cases, the vibration isolators are active isolators that impose a vibration that reduces and/or cancels the vibrations from the vibration mechanism or from the vibrations generated by the user's workout on the top plate. The active vibration isolators may include a spring, a feedback circuit which includes a sensor, a controller, and an actuator. The vibration from the top plate is processed to determine the characteristics of the top plate. The characteristics of the vibration are fed to the actuator to produce another vibration that either reduces and/or cancels the vibrations from the top plate. The sensors may be positioned on a component of the treadmill or the platform that is connected to the top plate. In some examples, the active isolators may impose the canceling vibrations to components connected to the top plate, but not to the actual top plate. Further, in some examples, a combination of passive isolators and active isolators are used. The passive isolators may be used to reduce the vibrations that travel from the top plate to the other treadmill components, and the active isolators may be attached to the treadmill components that are intended to be vibration free.

The vibration isolators may be used to extend the life of the other treadmill components. For example, the vibration isolators may insulate and/or isolate the display, upright structure, pulleys in the deck, the tread belt, processors, memory, electronics, other components, or combinations thereof.

In some cases, the platform may include a weight scale. The weight scale may be large enough to allow the user to stand and/or exercise on the weight scale. One advantage to working out on a platform with a weight scale is that as the user performs certain types of exercises, like thrusting free weights over his head, the load felt by the weight scale changes. Detecting this change can be used to determine when and if the user actually performed the overhead lift. For example, in situations where the dumbbells are thrust over the user's head, the scale may measure an increased amount of weight. The processing resources in communication with the weight scale may associate a time stamp with the measured increase. Thus, the processing resources can determine statistics about the user's workout (e.g. how long the user executed the workout, how long between each repetition, start times, end times, and so forth).

The weight scale can also determine how much weight the user is using during the workout. For example, the weight scale can determine the weight of the user when the user is standing on the scale without holding weights. When the user picks up free weights, the weight scale can subtract the user's body weight from the total weight being measured. The difference between the total weight and the user's body weight can be determined to be the weight amount the user is holding.

Exercising on the scale can provide inputs for determining how many repetitions the user performed. For example, the weight scale may recognize weight fluctuation patterns that are characteristic of the user lifting or lowering free weights. As these patterns are recognized, the weight scale may cause a repetition counter to increment by one when a lift pattern is recognized.

The weight scale may include any appropriate type of measuring mechanism. In some examples, the weight scale includes a piezoelectric material that changes its electrical properties in response to a mechanical load. In other examples, the weight scale may include a magnetostrictive material that changes its magnetic properties in response the mechanical load. In yet other examples, the weight scale may also include a spring mechanism, a strain gauge, a hydraulic mechanism, a pneumatic mechanism, another type of measuring mechanism, or combinations thereof.

In some cases, the tread belt passes over the region of the treadmill deck that contains the weight scale. In this example, the treadmill can determine when the user is holding weight while standing on the tread belt, like in situations where the user is carrying free weights during a walk or run. In response to determining that the user is carrying free weights during a walk or run, the treadmill can increase the calorie burn count.

In some situations, the treadmill guides the user with a programmed workout. In some cases, the programmed workout alters the tread belt's speed, the incline of the deck, and other factors affecting the aerobic portion of the workout. Additionally, the programmed workout may include anaerobic portions as well. In these instances, the programmed workout may instruct the user to perform certain types of lifts with the free weights. In some cases, the programmed workout may select the amount of weight that the user is to lift. In embodiments where the free weight rack includes an adjustable dumbbell, the treadmill may cause the adjustable dumbbell to select the amount of weight prescribed by the programmed workout. In other instances, the treadmill may allow the user to select the amount of weight to lift even if the programmed workout instructs the user to lift a predetermined amount.

The predetermined weight amount recommended in the programmed workout may be based on information about the user. This information may be derived from history compiled with fitness trackers, previous workouts on the treadmill, age information, height information, body composition information, gender information, other types of personal information, or combinations thereof. In some instances, the treadmill is in communication with a remote computing device that contains a user profile detailing fitness information about the user. The treadmill or a remote computing device may also take into consideration the user's fitness goals when selecting the type of lifts to perform, the amount of weight to perform with the lifts, and the number of repetitions.

The weight scale can be used to determine if the user selected the recommended weight amount. In those situations where the user selected a different weight amount than the recommended amount, the programmed workout can alter an aspect of the workout. For example, if the user selected a weight amount that is heavier than the recommended amount, the programmed workout can reduce the number of repetitions that the user is instructed to lift. Further, the calorie burn count can also be adjustable based on the weight amount that the user actually selects instead of the weight amount instructed by the programmed workout.

The weight scale can also be used to verify that the user performs the number of recommended lifts. In this example, the weight scale can cause a repetition counter to increment by one when the weight scale detects a weight fluctuation pattern characteristic of performing a lift. In some examples, a separate repetition counter is used to determine the number of repetitions performed by the user. For example, an optical camera can be incorporated into the treadmill's upright structure. The optical camera can record and analyze information to determine the number of lifts performed by the user and, in some instances, whether the user performed the type of lift instructed by the programmed workout.

In some cases, the programmed workout's instructions can be presented to the user through a display in the console. The programmed workout can present the number of lifts to perform, the type of lifts to perform, the next type of exercise to perform, and so forth. In some case, the display screen can instruct the user on how to perform the lift. For instance, the programmed workout may instruct the user to perform negatives by lifting up quickly and lowering the weight slowly, or the programmed workout may instruct the user to perform the same type of lift by lifting up and lowering the weight at the same rate. In other examples, a speaker may be used to audibly instruct the user about the programmed workout.

Information relating to both the anaerobic and aerobic portions of the workout can be present to the user. For instance, the repetition count may be presented in the display, the calories burned during the workout may be presented in the display, the user's heart rate or other physiological parameters be presented in the display, and so forth.

In some case, the treadmill is in communication with a remote device, and the information recorded about the workout is sent to the remote device. In one instance, the information is sent to the user's mobile device and the user follows the workout with his or her mobile device.

The instruction system for instructing the user about the workout may include a combination of hardware and programmed instructions for executing the functions of the instruction system. The instruction system may include processing resources that are in communication with memory resources. Processing resources include at least one processor and other resources used to process the programmed instructions. As described herein, the memory resources may represent generally any memory capable of storing data such as programmed instructions or data structures used by the instruction system.

The processing resources may include I/O resources that are capable of being in communication with a remote device that stores user information, workout history, external resources, databases, or combinations thereof. The remote device may be a mobile device, a cloud based device, a computing device, another type of device, or combinations thereof. In some examples, the instruction system communicates with the remote device through a mobile device which relays communications between the instruction system and the remote device. In other examples, the mobile device has access to information about the user. The remote device may collect information about the user throughout the day, such as tracking calories, exercise, activity level, sleep, other types of information, or combination thereof.

The remote device may execute a program that can provide useful information to the instruction system. An example of a program that may be compatible with the principles described herein includes the iFit program which is available through www.ifit.com identified above. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources includes a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the instruction system through a digital input/output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The memory resources may include instructions for simulating an aerobic exercise instructor that represent programmed instructions that, when executed, cause the processing resources to control the aerobic portion of the user's workout. The aerobic exercise may include, but is not limited to, walking, running, shuffling, skipping, biking, jumping, or otherwise moving while the tread belt is in operation. The aerobic exercise instructor may control the speed of the tread belt based on the user's heart rate or other physiological readings, the user's goals, programmed workouts, inputs from the user, or combinations thereof.

The memory resources may also include instructions for simulating an anaerobic exercise instructor that represent programmed instructions that, when executed, cause the processing resources to control the anaerobic portions of the user's workout. The anaerobic exercise instructor may instruct the user to perform lifts, perform a number of repetitions, perform a type of lift, perform other aspects of the anaerobic portion of the workout, perform other aspects of the workout, or combinations thereof.

The memory resources may also include a weight selector that represents programmed instructions that, when executed, cause the processing resources to select the amount of weight to lift. In one embodiment, the free weights include an adjustable dumbbell, and a selector is incorporated into the rack. The selector adjusts the dumbbell so that the desired amount of weight is automatically attached to the dumbbell's handle, and the user does not have to make the adjustment manually.

The repetition count instructor represents programmed instructions that, when executed, cause the processing resources to instruct the user to perform a number of lifts. The lift number may be presented to the user through a display, through a speaker, another mechanism, or combinations thereof.

The weight verifier represents programmed instructions that, when executed, cause the processing resources to verify that the user is lifting the weight. In some cases, the weight verifier also verifies that the user is lifting the amount of weight instructed by the instruction system.

The counter verifier represents programmed instructions that, when executed, cause the processing resources to verify that the user is performing the instructed number of lifts. This count verification may be based on images captured with an optical sensor, the fluctuations measured at the weight scale, another type of sensor, or combinations thereof. The count verification may be presented in a console or display integrated into the treadmill, a mobile device in communication with the treadmill, a remote device in communication with the treadmill, or combinations thereof.

The vibration recorder represents programmed instructions that, when executed, cause the processing resources to record vibrations imposed from the top plate. The vibrations may be imposed by the vibration mechanism or by the movements of the user. In some cases, the vibration recorder records the vibrations when no one is on the top plate. This recorded vibration may become a baseline signature to which other vibrations signatures are compared to. The recorder may also record the vibrations of the top plate when a user is standing on the top plate of the platform or otherwise performing exercises on the top plate.

The vibration comparer represents programmed instructions that, when executed, cause the processing resources to compare baseline signature with the vibration signatures taken when the user is on the plate or performing movements on the plate. Based on the characteristics of the vibration signatures the processor may determine the weight of the user, the amount of weight used by the user, the type of exercise performed by the user, the number of repetitions performed by the user, other characteristics about the user's workout, or combinations thereof.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the treadmill, the adjustable dumbbell, the mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

The invention claimed is:

1. A treadmill comprising:

a deck;

a first pulley disposed in the deck;

a second pulley disposed in the deck;

a tread belt surrounding the first pulley and the second pulley;

an electronic sensor incorporated into the treadmill and configured to automatically produce measurement data in response to exercise movement performed by a user over the deck;

an electronic console including an electronic display;

a processor; and a memory including programmed instructions that, when executed, cause the processor to:

automatically analyze the measurement data produced by the electronic sensor to automatically determine a characteristic of the exercise movement performed by the user over the deck, wherein determining the characteristic includes determining a type of exercise performed by the user over the deck; and automatically present, on the electronic display, an indication of the characteristic of the exercise movement performed by the user over the deck.

2. The treadmill of claim 1, wherein the characteristic of the exercise movement performed by the user over the deck includes a repetition count in the exercise movement performed by the user over the deck.

3. The treadmill of claim 2, wherein the repetition count is of a weight lifting exercise movement.

4. The treadmill of claim 2, wherein the repetition count is of a military press exercise movement.

5. The treadmill of claim 2, wherein the repetition count is of a curl exercise movement.

6. The treadmill of claim 2, wherein the repetition count is of a jumping exercise movement.

7. The treadmill of claim 2, wherein the repetition count is of a push-up exercise movement.

8. The treadmill of claim 2, wherein the repetition count is of a leg lift exercise movement.

9. The treadmill of claim 2, wherein the repetition count is of a sit-up exercise movement.

10. The treadmill of claim 1, wherein the type of exercise is at least one of a weight lifting exercise, a military press exercise, a curl exercise, a jumping exercise, a push-up exercise, a leg lift exercise, or a sit-up exercise.

11. The treadmill of claim 1, wherein the electronic sensor is an accelerometer.

12. The treadmill of claim 1, wherein the electronic sensor is an optical sensor.

13. The treadmill of claim 1, wherein the electronic sensor is a laser displacement sensor.

14. The treadmill of claim 1, wherein the electronic sensor is a camera.

15. The treadmill of claim 1, wherein the electronic sensor is a capacitance sensor.

16. The treadmill of claim 1, wherein the electronic sensor is a strain gauge.

17. The treadmill of claim 1, wherein the electronic sensor is a geophone.

18. The treadmill of claim 1, wherein the electronic sensor is incorporated into the electronic console.

19. The treadmill of claim 1, wherein the electronic sensor is incorporated into the deck.

* * * * *